US012037850B2

(12) United States Patent
Portwood et al.

(10) Patent No.: US 12,037,850 B2
(45) Date of Patent: Jul. 16, 2024

(54) DRILL BIT FOR USE WITH INTENSIFIED FLUID PRESSURES

(71) Applicant: Schlumberger Technology Corporation, Sugar Land, TX (US)

(72) Inventors: Gary R. Portwood, Saline (IT); Luca Tedeschi, Saline (IT); Alessandro Bertini, Saline (IT); Simone Pallesi, Saline (IT); Johann Obermair, Celle (DE); James Layne Larsen, Spring, TX (US); Alessio Cechi, Saline (IT)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/059,259

(22) Filed: Nov. 28, 2022

(65) Prior Publication Data

US 2023/0097242 A1 Mar. 30, 2023

Related U.S. Application Data

(63) Continuation of application No. 17/250,079, filed as application No. PCT/US2019/033035 on May 20, 2019, now Pat. No. 11,512,536.

(Continued)

(51) Int. Cl.

| | |
|---|---|
| ***E21B 10/18*** | (2006.01) |
| *E21B 10/60* | (2006.01) |
| *E21B 17/18* | (2006.01) |

(52) U.S. Cl.

CPC ..... *E21B 10/18* (2013.01); *E21B 10/60* (2013.01); *E21B 17/18* (2013.01)

(58) Field of Classification Search

CPC . E21B 7/18; E21B 10/18; E21B 17/18; E21B 10/60

See application file for complete search history.

(56) References Cited

U.S. PATENT DOCUMENTS

| | | | |
|---|---|---|---|
| 4,185,706 | A | 1/1980 | Baker, III |
| 5,601,153 | A | 2/1997 | Ensminger |

(Continued)

FOREIGN PATENT DOCUMENTS

| | | | |
|---|---|---|---|
| CN | 201265360 | Y | 7/2009 |
| CN | 202706914 | U | 1/2013 |

(Continued)

OTHER PUBLICATIONS

International Search Report and Written Opinion issued in International Patent application PCT/US2019/033035 on Aug. 29, 2019, 12 pages.

(Continued)

*Primary Examiner* — Yong-Suk (Philip) Ro

(74) *Attorney, Agent, or Firm* — Jeffrey D. Frantz

(57) ABSTRACT

A cutting bit includes a bit body and high-pressure body with a high-pressure fluid conduit therethrough. The high-pressure body and bit body are joined together. The high-pressure fluid conduit is configured to convey a fluid at greater than 14.5 ksi, and in some embodiments greater than 40 ksi. The high-pressure fluid conduit may direct the fluid through a nozzle in a fluid jet to weaken material, such as an earth formation. The cutting bit includes at least one roller cone and/or blades with cutting elements thereon to remove the weakened material. A cutting bit includes both high and low-pressure fluid conduits, and high and low-pressure fluid nozzles. The high-pressure nozzles receive fluid flow from a downhole pressure intensifier, and a connection between the (Continued)

bit and the downhole pressure intensifier includes rigid connectors, flexible connectors, or a combination thereof.

19 Claims, 25 Drawing Sheets

Related U.S. Application Data

(60) Provisional application No. 62/674,512, filed on May 21, 2018.

(56) References Cited

U.S. PATENT DOCUMENTS

| | | | | |
|---|---|---|---|---|
| 5,787,998 | A | 8/1998 | OHanlon et al. | |
| 5,862,871 | A | 1/1999 | Curlett | |
| 6,289,998 | B1 | 9/2001 | Krueger et al. | |
| 7,681,670 | B2 * | 3/2010 | Centala | E21B 10/08 175/339 |
| 8,544,567 | B2 | 10/2013 | Comeau | |
| 8,827,009 | B1 | 9/2014 | Rankin, III | |
| 2005/0189148 | A1 | 9/2005 | Larsen | |
| 2005/0217899 | A1 | 10/2005 | Hossain | |
| 2007/0125580 | A1 | 6/2007 | Hall | |
| 2013/0199849 | A1 | 8/2013 | Li et al. | |
| 2014/0116783 | A1 | 5/2014 | Villareal et al. | |
| 2018/0112469 | A1 | 4/2018 | Ghaziani | |
| 2020/0014082 | A1 | 1/2020 | Srinivasan et al. | |
| 2021/0140245 | A1 | 5/2021 | Portwood | |
| 2021/0277721 | A1 | 9/2021 | Portwood | |

FOREIGN PATENT DOCUMENTS

| | | | |
|---|---|---|---|
| CN | 106194029 | A | 12/2016 |
| WO | 2018121815 | A1 | 7/2018 |

OTHER PUBLICATIONS

International Preliminary Report on Patentability issued in International Patent application PCT/US2019/033035 on Nov. 24, 2020, 7 pages.

SITEC-Sieber Engineering AG, Fittings Catalogue 720.00, pp. 41-43 downloaded from https://www.sitec-hp.ch/en/High-pressure-valves/Fittings-1, 2018.

International Search Report and Written Opinion issued in International Patent application PCT/US2019040674 on Oct. 23, 2019, 14 pages.

International Preliminary Report on Patentability issued in International Patent application PCT/ on PCT/US2019040674 on Jan. 21, 2021, 10 pages.

Office Action issued in U.S. Appl. No. 17/25/,512 dated Feb. 3, 2022, 9 pages.

Extended Search and Examination Report issued in European Patent Application No. 19833515.0 dated Jan. 17, 2022, 7 pages.

Extended Search and Examination Report issued in European Patent Application No. 19808047.5 on Feb. 7, 2022, 7 pages.

Office Action issued in U.S. Appl. No. 18/161,612 on Oct. 5, 2023, 14 pages.

* cited by examiner

DRILL BIT FOR USE WITH INTENSIFIED FLUID PRESSURES

This application is a continuation application of U.S. patent application Ser. No. 17/250,079 filed on Nov. 20, 2020 under 35 U.S.C. § 371 as a national stage application of International Patent Application No. PCT/US2019/033035, filed May 20, 2019, which claims priority from U.S. Provisional Application No. 62/674,512, filed May 21, 2018, each of which is incorporated by reference in its entirety.

BACKGROUND

Downhole systems may be used to drill, service, or perform other operations on a wellbore in a surface location or a seabed for a variety of exploratory or extraction purposes. For example, a wellbore may be drilled to access valuable subterranean resources, such as liquid and gaseous hydrocarbons and solid minerals stored in subterranean formations, and to extract the resources from the formations.

Drilling systems are conventionally used to remove material from earth formations and other material, such as concrete, through primarily mechanical means. Drag bits, roller cone bits, reciprocating bits, and other mechanical bits fracture, pulverize, break, or otherwise remove material through the direct application of force. Different formations require different amounts of force to remove material. Increasing the amount of mechanical force applied to the formation includes increasing the torque and weight on bit on the drilling system, both of which introduce additional challenges to the drilling system.

Some mechanical bits include fluid conduits therethrough to direct drilling fluid to the cutting elements in order to flush cuttings and other debris from the cutting surfaces of the bit. Efficient removal of waste from the cutting area of the bit can reduce the torque and WOB used to remove material from the formation. Increasing the fluid pressure in a conventional bit erodes the bit and decreases the reliability and operational lifetime of the bit. A bit with one or more features that reduce the mechanical force to remove material from the formation without adversely affecting the reliability and lifetime of the bit is, therefore, desirable.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In an embodiment, a device for removing material includes a bit body and a high-pressure ("HP") body connected together. The high-pressure body has an HP fluid conduit that provides fluid communication through the HP body to at least one nozzle that is connected to the HP body. The HP fluid conduit is capable of withstanding fluid pressures greater than 40 kilopounds per square inch (kpsi) (276 megapascals (MPa)).

In another embodiment, a bit includes a bit body and an HP body connected together. The high-pressure body has an HP fluid conduit that provides fluid communication through the HP body to at least one nozzle that is connected to the HP body. The bit body has a center axis about which the bit can rotate. The bit body also has a low-pressure ("LP") fluid conduit located in the body. The HP fluid conduit is capable of withstanding fluid pressures greater than 40 kpsi (276 MPa).

In yet another embodiment, a method of removing material from a formation includes flowing a fluid through an HP fluid conduit in a bit at a fluid pressure greater than 40 kpsi (276 MPa), directing the fluid at the formation in a fluid jet, weakening the formation with the fluid jet to create a weakened region of the formation, removing at least a portion of the weakened region as cuttings, and flushing the cuttings from the weakened region.

In a yet further embodiment, a method of manufacturing a bit is described. The method includes forming an HP body with an HP fluid conduit therein, forming a bit body, and joining the HP body and the bit body.

Additional features of embodiments of the disclosure will be set forth in the description which follows, and in part will be obvious from the description, or may be learned by the practice of such embodiments. The features of such embodiments may be realized and obtained by means of the instruments and combinations particularly pointed out in the appended claims. These and other features will become more fully apparent from the following description and appended claims, or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 23-1 is a cross-sectional view of a downhole drilling system, according to the present disclosure.

FIG. 23-2 is a side view of the embodiment of FIG. 23-1, according to the present disclosure.

FIG. 24-1 is a cross-sectional view of a downhole drilling system, according to the present disclosure.

FIG. 24-2 is a side view of the embodiment of FIG. 23-1, according to the present disclosure.

FIG. 26-1 is a cross-sectional view of a downhole drilling system, according to the present disclosure.

FIG. 26-2 includes side assembled and partially disassembled views of the embodiment of FIG. 26-1, according to the present disclosure.

DETAILED DESCRIPTION

One or more specific embodiments of the present disclosure will be described below. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

This disclosure generally relates to devices, systems, and methods for directing a high-pressure fluid jet through a cutting bit. More particularly, the present disclosure relates to embodiments of cutting bits having a reinforced portion of the cutting bit to communicate a fluid therethrough at a pressure sufficient to remove material from an earth formation, thereby increasing a rate of penetration of the cutting bit, reducing the likelihood of a cutting element and/or a bit body failure, or combinations thereof. While a drill bit for cutting through an earth formation is described herein, it should be understood that the present disclosure may be applicable to other cutting bits such as milling bits, reamers, hole openers, and other cutting bits, and through other materials, such as cement, concrete, metal, or formations including such materials.

Figure 1:
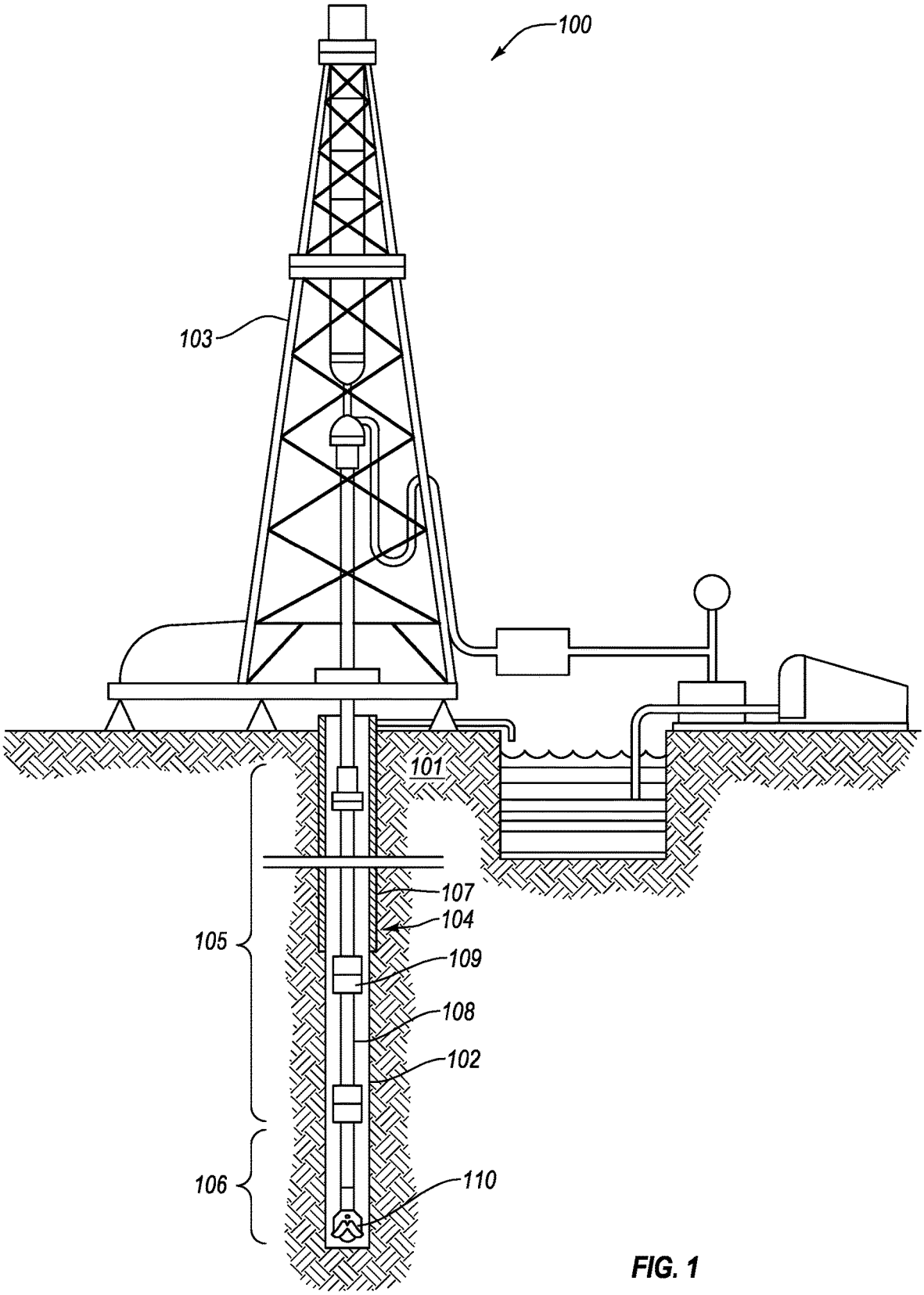
FIG. 1 is a schematic representation of an embodiment of a drilling system, according to the present disclosure.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 a connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits (see FIG. 14) and roller cone bits (see FIG. 2). In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Figure 2:
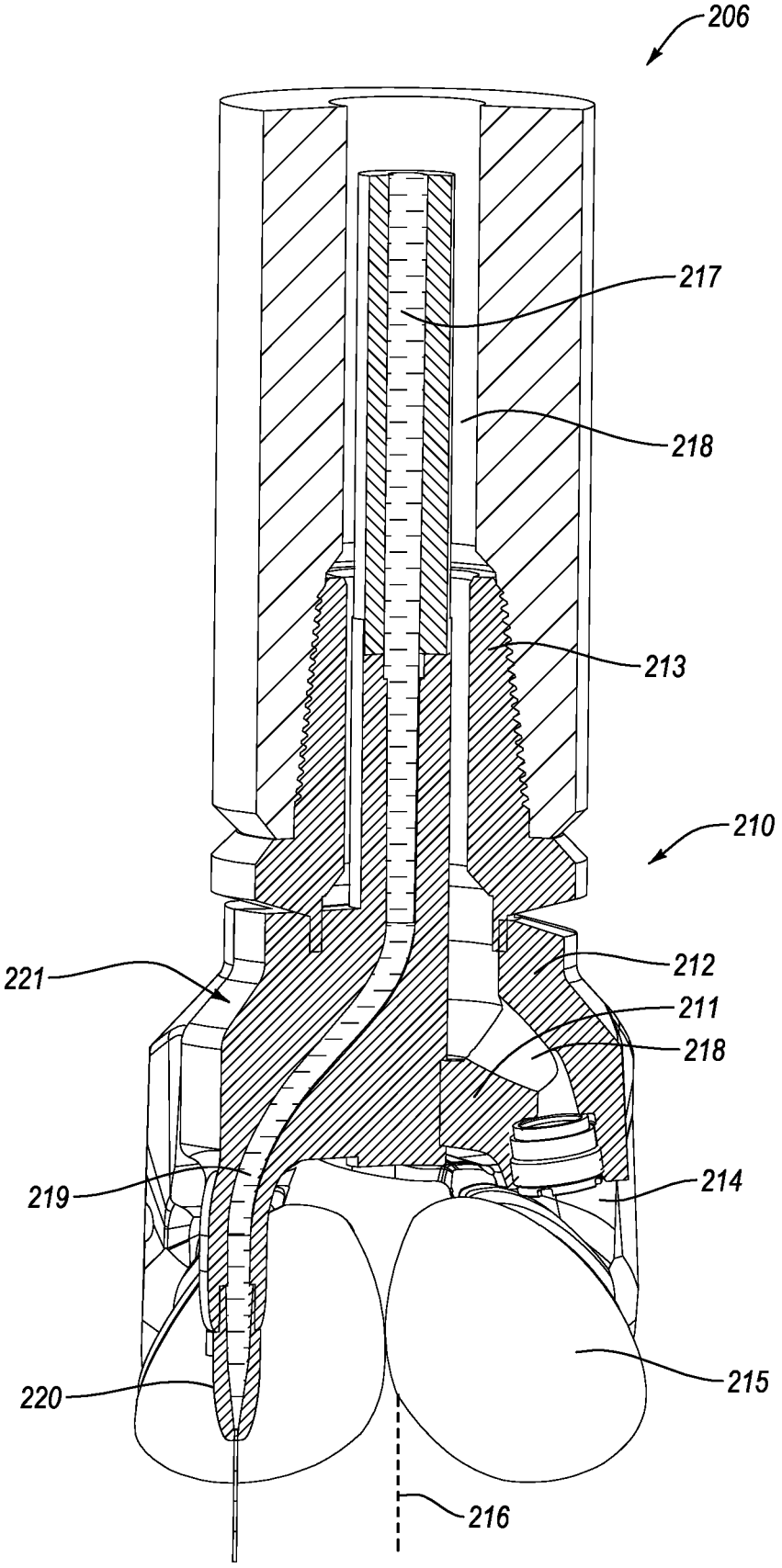
FIG. 2 is a side partial cutaway view of an embodiment of a bit having a bit body and a high-pressure ("HP") body joined together, according to the present disclosure.

FIG. 2 illustrates an embodiment of a bit 210 in a BHA 206 having a high-pressure ("HP") fluid conduit and a low-pressure ("LP") fluid conduit in a bit body 211 thereof. The bit 210 generally includes a bit body 211, a shank 212, and a threaded connection or pin 213 for connecting the bit 210 to a drill string (e.g., drill string 105 of FIG. 1) that is employed to rotate the bit 210 in order to drill the borehole. The bit 210 is a roller cone bit having a plurality of arms 214, each supporting a roller cone 215 that is rotatable relative to the arm 214 and/or to the bit body 211. The bit 210 further includes a center axis 216 about which the bit 210 rotates.

The bit 210 includes an HP fluid conduit 217 and a LP fluid conduit 218. The HP fluid conduit 217 may flow fluid 219 to a nozzle 220. The nozzle 220 directs the fluid at a high-pressure toward a formation, casing, or other material to be cut and/or weakened by the fluid. The LP fluid conduit 218 may flow fluid through toward one or more openings in the bit body 211 to flush debris away from the body 211, arms 214, and roller cones 215.

The fluid 219 in the HP fluid conduit 217 and the LP fluid conduit 218 may be the same. In other embodiments, the fluid 219 in the HP fluid conduit 217 and the LP fluid conduit 218 may be different fluids. For example, the LP fluid conduit 218 may flow a drilling fluid (e.g., drilling mud) therethrough to flush debris from around the bit 210. The HP fluid conduit 217 may experience higher rates of wear and/or erosion due at least to the higher fluid pressures compared to the LP fluid conduit 218. The drilling fluid may contain particulates or contaminants in mixture and/or suspension that may damage the HP fluid conduit 217. The HP fluid conduit 217 may flow a fluid 219 that is free of particulates, such as clean water, clean oil, or other liquid free of particulates. In at least one embodiment, the HP fluid conduit 217 may be in fluid communication with an HP fluid pump (e.g., downhole pressure intensifier) located in the drill string (such as drill string 105 of FIG. 1), in the BHA (such as BHA 106 of FIG. 1), at the bit pin connection, at the surface, or combinations thereof.

The HP fluid conduit 217 may contain the fluid 219 at a fluid pressure in a range having upper and lower values including any of 40 kilopounds per square inch (kpsi) (276 megapascals (MPa)), 45 kpsi (310 MPa), 50 kpsi (345 MPa), 55 kpsi (379 MPa), 60 kpsi (414 MPa), 65 kpsi (448 MPa), 70 kpsi (483 MPa), 75 kpsi (517 MPa), 80 kpsi (552 MPa), or any values therebetween. For example, the HP fluid conduit 217 may contain fluid 219 at a fluid pressure in a range of 40 kpsi (276 MPa) to 80 kpsi (552 MPa). In another example, the HP fluid conduit 217 may contain fluid 219 at a fluid pressure in a range of 50 kpsi (345 MPa) to 70 kpsi (483 MPa). In yet another example, the HP fluid conduit 217 may contain fluid 219 at a fluid pressure about 60 kpsi (414 MPa). In at least one embodiment, the fluid pressure of the HP fluid conduit 217 may be greater than 60 kpsi (414 MPa).

The HP fluid conduit 217 may be cast, machined, molded, or otherwise formed in an HP body 221. In some embodiments, the HP body 221 and the bit body 211 may be made of or include different materials. For example, the HP body 221 may be made of or include erosion resistant materials to withstand erosion by the movement of the fluid 219 in the HP fluid conduit 217. In another example, the HP body 221 may be made of or include high strength alloys or materials to limit or prevent cracking of the HP body when the fluid 219 is pressurized over 40 kpsi (276 MPa), over 50 kpsi (345 MPa), over 60 kpsi (414 MPa), etc.

In some embodiments, the HP body 221 may be made of or include high strength steel, low carbon steel, superalloys, Maraging (martensitic-aging) steel, tungsten carbide, PDC, or other erosion-resistant materials. The HP body 221 may be cast, machined, or built by additive manufacturing such that the HP fluid conduit 217 is integrally formed within the HP body 221. For example, the HP body 221 may be sand-cast with the HP fluid conduit 217 formed in the HP body 221. In another example, the HP fluid conduit 217 may be machined (i.e., bored) through a monolithic HP body 221 to produce the HP fluid conduit 217. In yet another example, additive manufacturing (such as selective laser melting ("SLM") or selective laser sintering ("SLS") may build up the HP body 221 one layer at a time while forming the HP fluid conduit 217 simultaneously.

The HP body 221 may be heat treated and/or tempered after the additive manufacturing. For example, the HP body 221 may be solubilized and/or normalized to homogenize the microstructure (e.g., inducing partial and/or complete recrystallization or grain growth) to alter the mechanical properties from the as-melted or as-sintered material.

The HP body 221 may be connected to the bit body 211 by a variety of connection methods or combinations thereof. In some embodiments, the HP body 221 may be bonded to the bit body 211, for example, by welding, brazing, or other bonding of the materials of the HP body 221 and the bit body 211. In other embodiments, the HP body 221 and the bit body 211 may be joined by one or more mechanically interlocking features, such as a tongue-and-groove connection, a dovetail connection, a friction fit, a pinned connection, or combinations thereof. For example, non-weldable materials, such as tungsten carbide may be joined by a sliding dovetail connection between the HP body 221 and the bit body 211, and the HP body 221 and bit body 211 may be fixed relative to one another by subsequent securing of the HP body 221 and the bit body 211 in the direction of the sliding dovetail (such as by welding a cap over the connection). In yet other embodiments, the HP body 221 and the bit body 211 may be joined with the use of one or more adhesives. In at least one embodiment, the HP body 221 and the bit body 211 may be joined by a combination of the foregoing, such as through welding of mechanically interlocking faces of the HP body 221 and the bit body 211.

Figure 3:
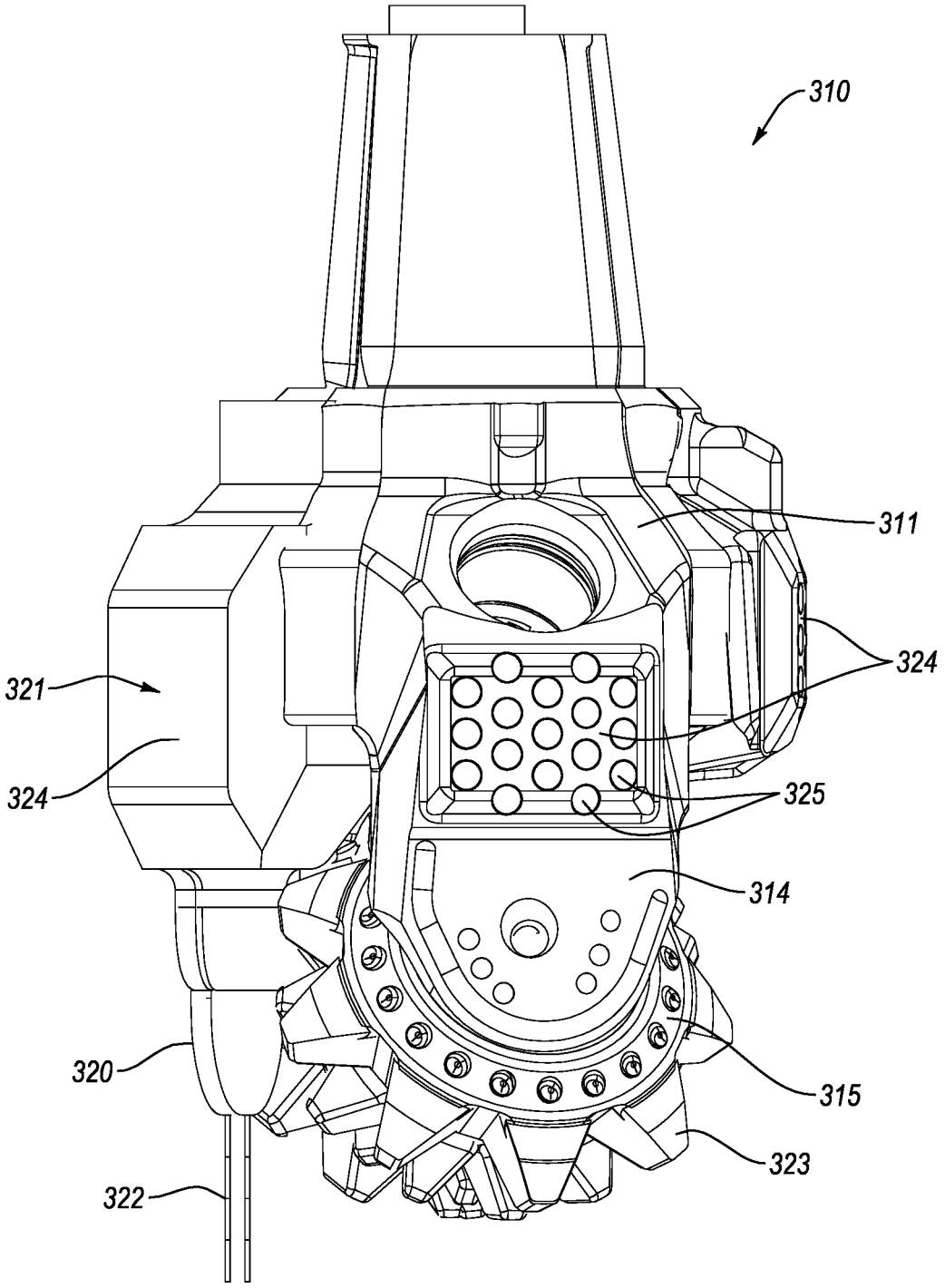
FIG. 3 is a side view of an embodiment of a roller cone bit with an HP body joined thereto, according to the present disclosure.

FIG. 3 illustrates a side view of another embodiment of a bit 310. The bit 310 depicted in FIG. 3 has two roller cones 315 supported by arms 314 on opposing sides of a bit body 311. The bit body 311 is welded to an HP body 321. The bit body 311 and/or the HP body 321 include a gage surface 324. The gage surface 324 may be the radially outermost surface of the bit body 311 and/or the HP body 321. The gage surface 324 may include one or more inserts 325 embedded and/or fixed thereto. For example, one or more inserts 325 may be located on a gage surface 324 of the bit body 311. In another example, one or more inserts 325 may be located on the gage surface 324 of the HP body 321.

The bit 310 may be rotatable, as described in relation to FIG. 1 and FIG. 2. At least one nozzle 320 may be positioned rotationally between the roller cones 315 of the bit 310. For example, the nozzle 320 may direct a fluid jet 322 from the nozzle 320 toward a location in the rotational path of the roller cones 315 and between the roller cones 315. The fluid jet 322 may weaken the formation or other material adjacent the bit 310 and the teeth 323 of the roller cones 315 may remove material.

Figure 4:
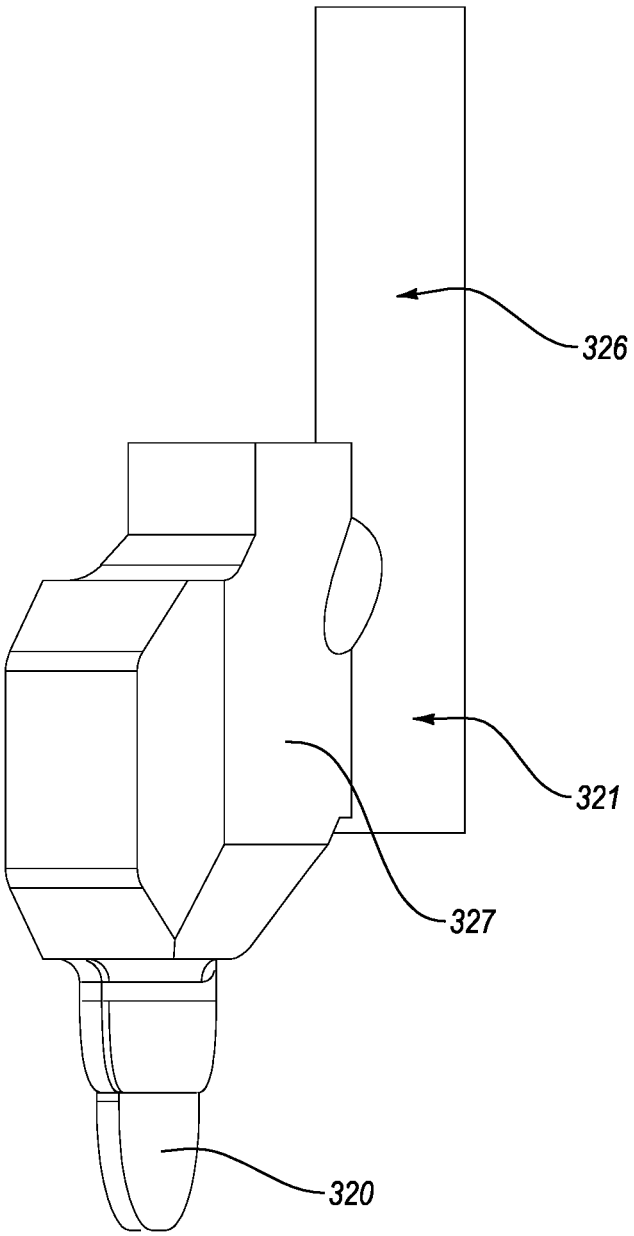
FIG. 4 is a transverse view of the embodiment of an HP body of FIG. 3, according to the present disclosure.

FIG. 4 illustrates the HP body 321 of the bit 310 shown in FIG. 3. The HP body 321 may have a shaft 326 that extends longitudinally (i.e., in the direction of the center axis of the bit). The shaft 326 is integrally formed in the HP body 321. The HP body 321 has a lateral surface 327 that may contact and/or abut the bit body. In some embodiments, at least a portion of the lateral surface 327 may be welded, brazed, or otherwise bonded to a portion of the bit body. In other embodiments, the lateral surface 327 may have one or more interlocking features that mechanically interlock with one or more complimentary interlocking features on the bit body.

In some embodiments, a nozzle 320 is integrally formed with the HP body 321. In other embodiments, the nozzle 320 be made of or include a different material from the HP body 321 and may be connected to the HP body 321 after manufacturing of the HP body 321. For example, the nozzle 320 may include or be made of an ultrahard material. As used herein, the term "ultrahard" is understood to refer to those materials known in the art to have a grain hardness of about 1,500 HV (Vickers hardness in kg/mm2) or greater. Such ultrahard materials can include but are not limited to diamond, sapphire, moissantite, polycrystalline diamond (PCD), leached metal catalyst PCD, non-metal catalyst PCD, hexagonal diamond (Lonsdaleite), cubic boron nitride (cBN), polycrystalline cBN (PcBN), binderless PCD or nanopolycrystalline diamond (NPD), Q-carbon, binderless PcBN, diamond-like carbon, boron suboxide, aluminum manganese boride, metal borides, boron carbon nitride, and other materials in the boron-nitrogen-carbon-oxygen system which have shown hardness values above 1,500 HV, as well as combinations of the above materials. In at least one embodiment, the nozzle 320 may be a monolithic PCD. For example, the nozzle 320 may consist of a PCD compact without an attached substrate. In another example, the nozzle 320 may have an ultrahard coating on an inner diameter of a substrate. In some embodiments, the ultrahard material may have a hardness values above 3,000 HV. In other embodiments, the ultrahard material may have a hardness value above 4,000 HV. In yet other embodiments, the ultrahard material may have a hardness value greater than 80 HRa (Rockwell hardness A).

Figure 5:
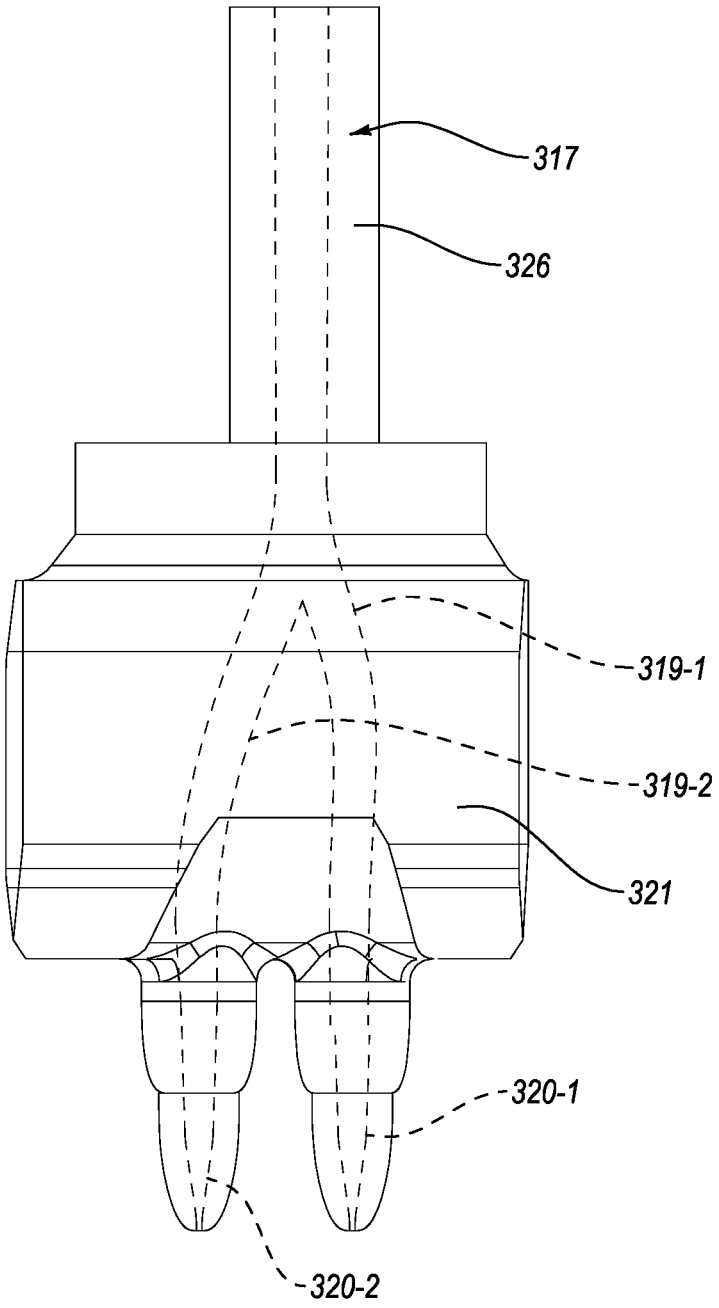
FIG. 5 is a side radial cutaway view of the embodiment of an HP body of FIG. 3, according to the present disclosure.

FIG. 5 is a cross-sectional view of the HP body 321 showing the HP fluid conduit 317 in the shaft 326 to the plurality of nozzles 320-1, 320-2. The HP body 321 has an HP fluid conduit 317 that divides to provide a first fluid 319-1 to the first nozzle 320-1 and a second fluid 319-2 to the second nozzle 320-2. In other embodiments, the HP body 321 may have a first HP fluid conduit and a second HP fluid conduit that are discrete from one another. For example, a first HP fluid conduit and a second HP fluid conduit may independently provide a first fluid to a first nozzle and a second fluid to a second nozzle without the first fluid and the second fluid mixing. A plurality of discrete HP fluid conduits may allow different fluids and/or different pressures to be utilized in different locations on the bit or for different applications.

Figure 6:
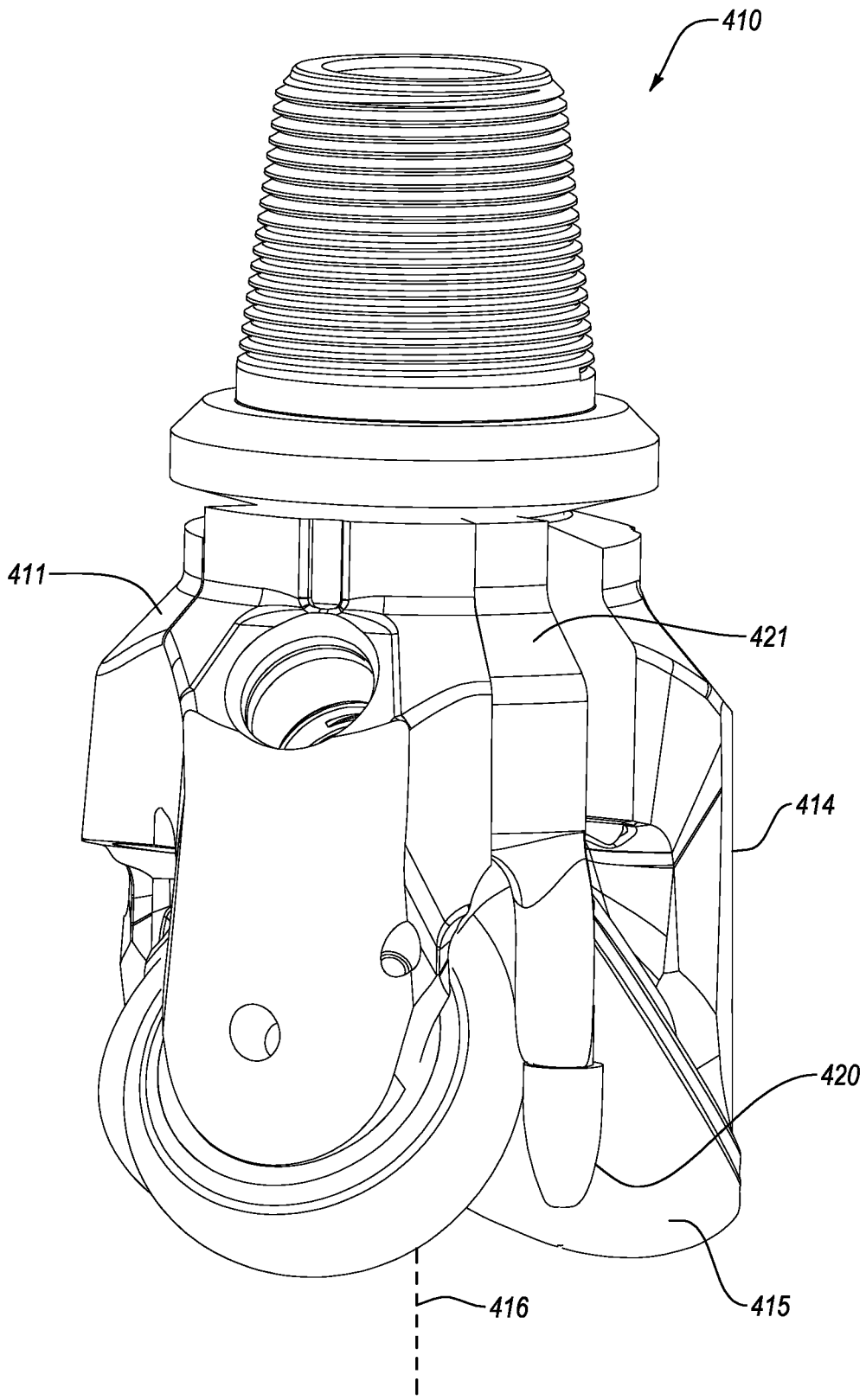
FIG. 6 is a side view of another embodiment of a roller cone bit with an HP body joined thereto, according to the present disclosure.

FIG. 6 illustrates another embodiment of a bit 410 including an HP body 421. The depicted bit 410 includes more than two roller cones 415 that are located at equal angular intervals relative to one another about the center axis 416 of the bit 410. For example, the depicted bit 410 has three arms 414 angularly spaced at 120° intervals. In other embodiments four arms may be spaced at 90° intervals. In yet other embodiments, five arms may be spaced at 72° intervals. In further embodiments, two or more arms 414 may be spaced at unequal angular intervals. Embodiments of bits with more arms 414 and/or roller cones 415 may have less angular space between the arms 414 and/or roller cones 415, limiting the number of nozzles 420 positionable between the arms 414 and/or roller cones 415. For example, the embodiment of a bit 310 described in relation to FIG. 3 through FIG. 5 has two roller cones 315 and the HP body 321 has two nozzles 320 in the angular space between the two roller cones 315, while the embodiment of a bit 410 in FIG. 6 through FIG. 10, has three arms 414 and roller cones 415 and the HP body 421 has one nozzle 420 in the angular space between roller cones 415.

Figure 7:
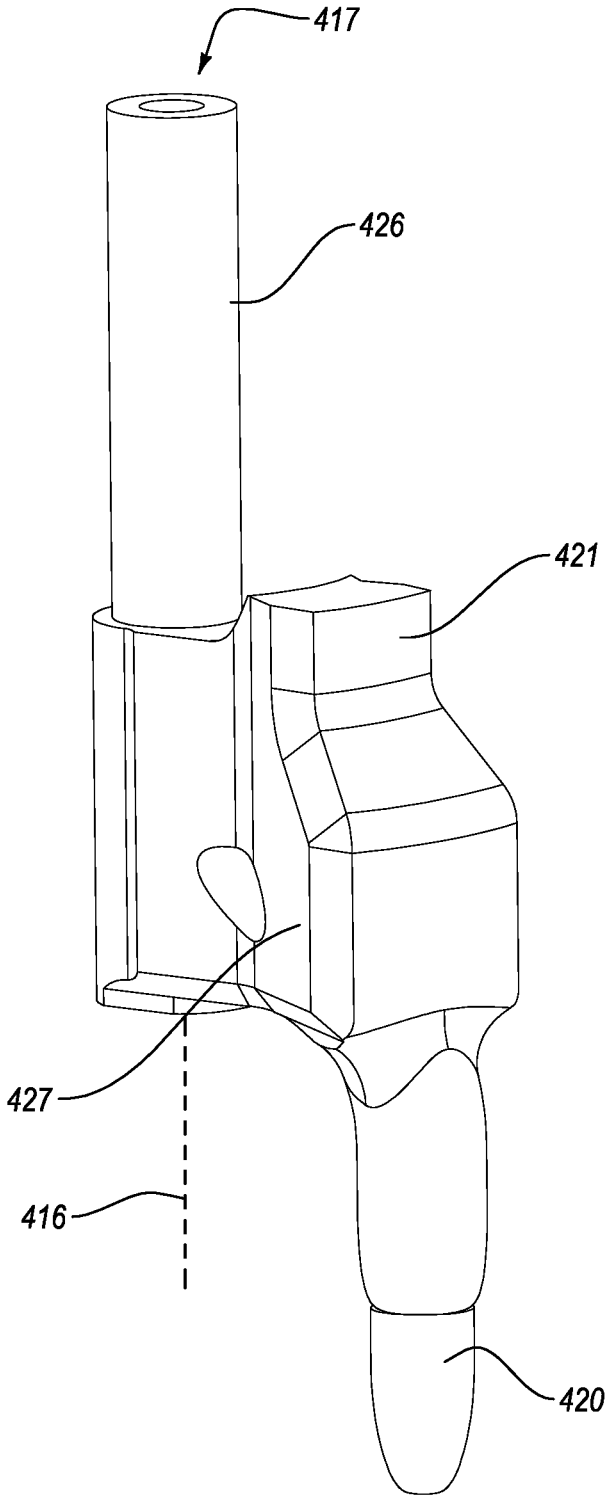
FIG. 7 is a perspective view of the embodiment of an HP body of FIG. 6, according to the present disclosure.

FIG. 7 illustrates the HP body 421 with a single nozzle 420 independent of the remainder of the bit. The HP body 421, similarly to the HP body 321 described in relation to FIG. 4, has a shaft 426 that extends longitudinally (i.e., in the direction of the center axis 416 of the bit). The shaft 426 is integrally formed in the HP body 421. The HP body 421 has a lateral surface 427 that may contact and/or abut the bit body. In some embodiments, at least a portion of the lateral surface 427 may be welded, brazed, or otherwise bonded to a portion of the bit body. In other embodiments, the lateral surface 427 may have one or more interlocking features that mechanically interlock with one or more complimentary interlocking features on the bit body.

Figure 8:
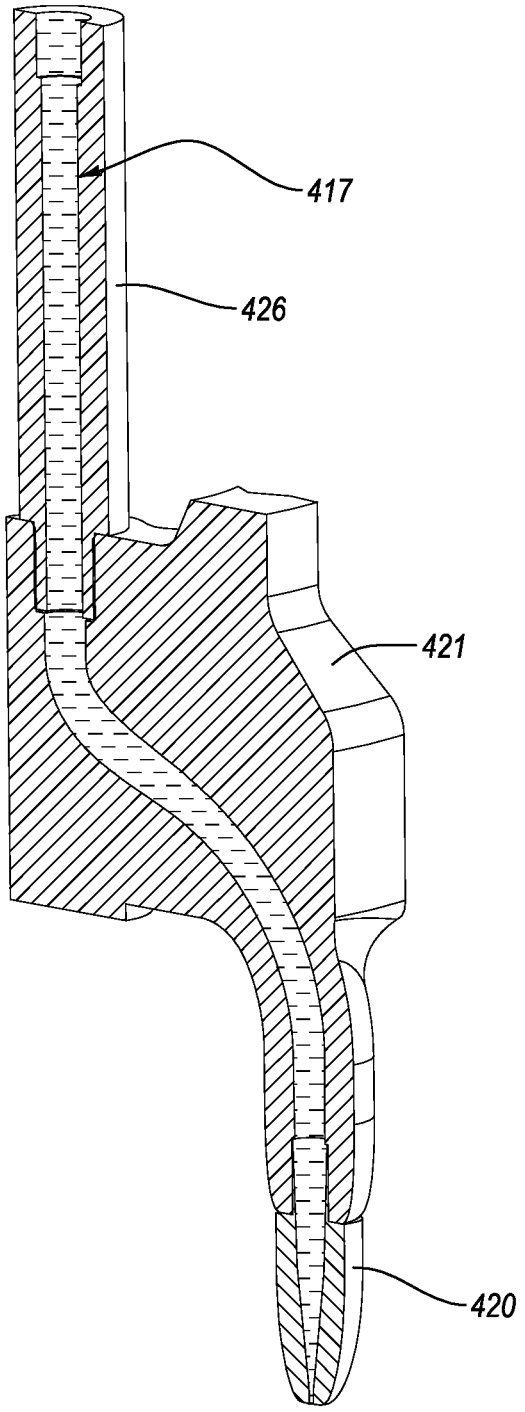
FIG. 8 is a longitudinal cross-section view of the embodiment of an HP body of FIG. 6, according to the present disclosure.

As shown in FIG. 8, a cross-section of the HP body 421 of FIG. 7 shows the HP fluid conduit 417 located at least partially in the shaft 426 and providing fluid communication through the longitudinal length of the HP body 421 to the nozzle 420. As shown in FIG. 8, the shaft 426 may be a separate component from the HP body 421. For example, the shaft 426 and HP body 421 may be bonded to one another, for example, by welding, brazing, or other bonding of the materials of the shaft 426 and HP body 421. In other embodiments, the shaft 426 and HP body 421 may be joined by one or more mechanically interlocking features, such as a tongue-and-groove connection, a dovetail connection, a friction fit, a pinned connection, or combinations thereof. For example, non-weldable materials, such as tungsten carbide may be joined by a sliding dovetail connection between the shaft 426 and HP body 421, and the shaft 426 and HP body 421 may be fixed relative to one another by subsequent securing of the shaft 426 and HP body 421 in the direction of the sliding dovetail (such as by welding a cap over the connection). In yet other embodiments, the shaft 426 and HP body 421 may be joined with the use of one or more adhesives. In at least one embodiment, the shaft 426 and HP body 421 may be joined by a combination of the foregoing, such as through welding of mechanically interlocking faces of the shaft 426 and HP body 421. In other embodiments, such as that described in relation to FIG. 4 and FIG. 5, the shaft may be integrally formed with the HP body.

Figure 9:
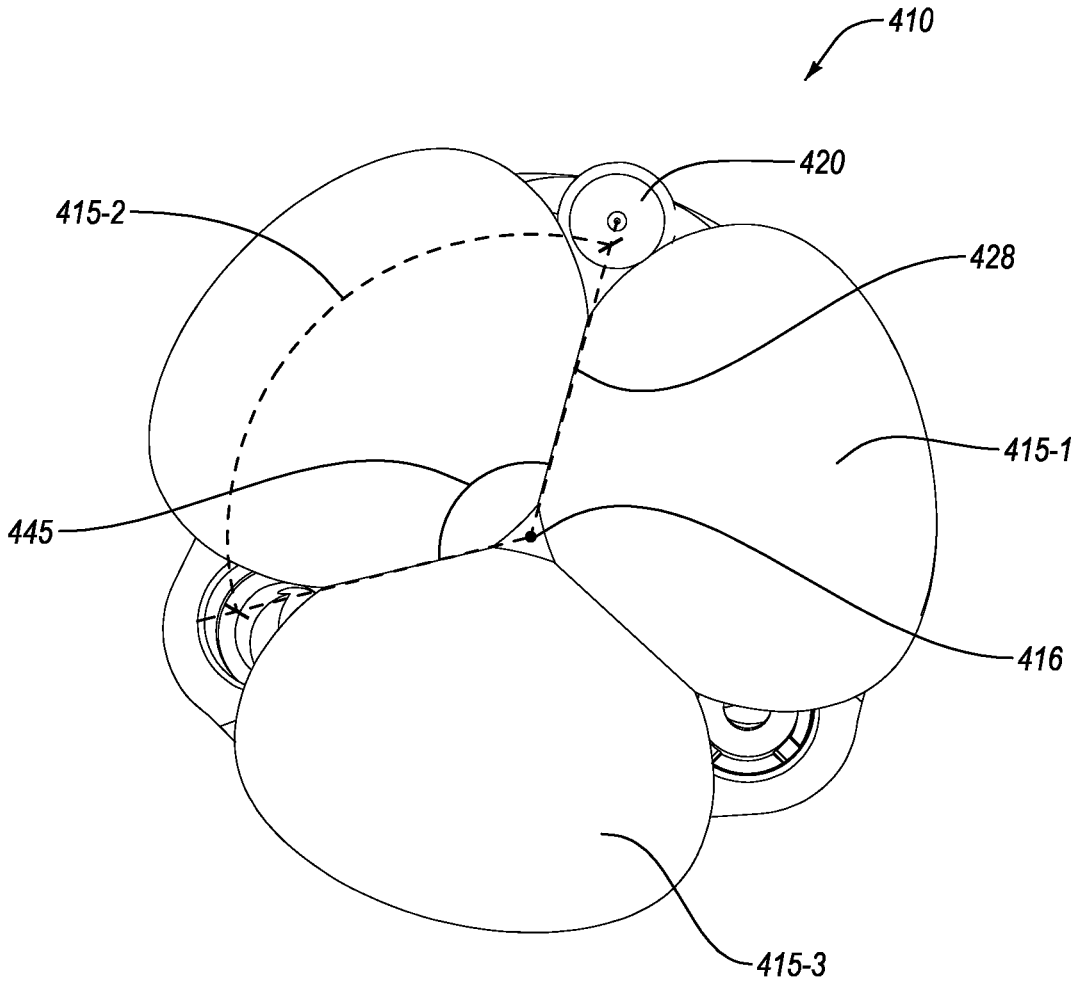
FIG. 9 is a bottom view of the embodiment of a roller cone bit of FIG. 6, according to the present disclosure.

Referring now to FIG. 9, the HP body and associate nozzle 420 are located angularly between two of the plurality of roller cones, for example, a first roller cone 415-1 and a second roller cone 415-2. In some embodiments, a bit 410 may include a plurality of HP bodies 421 and associated nozzles 420 connected to the bit body. For example, a bit 410 may have a second nozzle between the second roller cone 415-2 and the third roller cone 415-3. The angular spacing 445 between nozzles 420 may be at least partially dependent upon the angular spacing between the roller cones 415. The angular spacing 445 between a position of the nozzle 420 (between the first roller cone 415-1 and the second roller cone 415-2) and a position between the second roller cone 415-2 and the third roller cone 415-3 may be in a range having upper and lower values including any of 60°, 70°, 80°, 90°, 100°, 110°, 120°, 130°, 140°, 150°, 160°, 170°, 180°, or any values therebetween. For example, the angular spacing 445 between the nozzle 420 (between the first roller cone 415-1 and the second roller cone 415-2) and a position between the second roller cone 415-2 and the third roller cone 415-3 may be in a range of 60° to 180°. In another example, the angular spacing 445 between the nozzle 420 (between the first roller cone 415-1 and the second roller cone 415-2) and a position between the second roller cone 415-2 and the third roller cone 415-3 may be in a range of 80° to 130°. In yet another example, the angular spacing 445 between the nozzle 420 (between the first roller cone 415-1 and the second roller cone 415-2) and a position between the second roller cone 415-2 and the third roller cone 415-3 may be in a range of 90° to 120°.

The nozzle 420 is located a radial position 428 from the center axis 416. In some embodiments, the radial position 428 of the nozzle 420 may be in a range having upper and lower values including any of 50%, 55%, 60%, 65%, 70%, 75%, 80%, 85%, 90%, 95%, 100%, or any values therebetween of the total radius of the bit 410 (i.e., the distance from the center axis 416 to a gage surface). For example, the nozzle 420 may have a radial position 428 that is in a range of 50% to 100% of the total radius of the bit 410. In another example, the nozzle 420 may have a radial position 428 that is in a range of 60% to 95% of the total radius of the bit 410. In yet another example, the nozzle 420 may have a radial position 428 that is in a range of 70% to 90% of the total radius of the bit 410.

Figure 10:
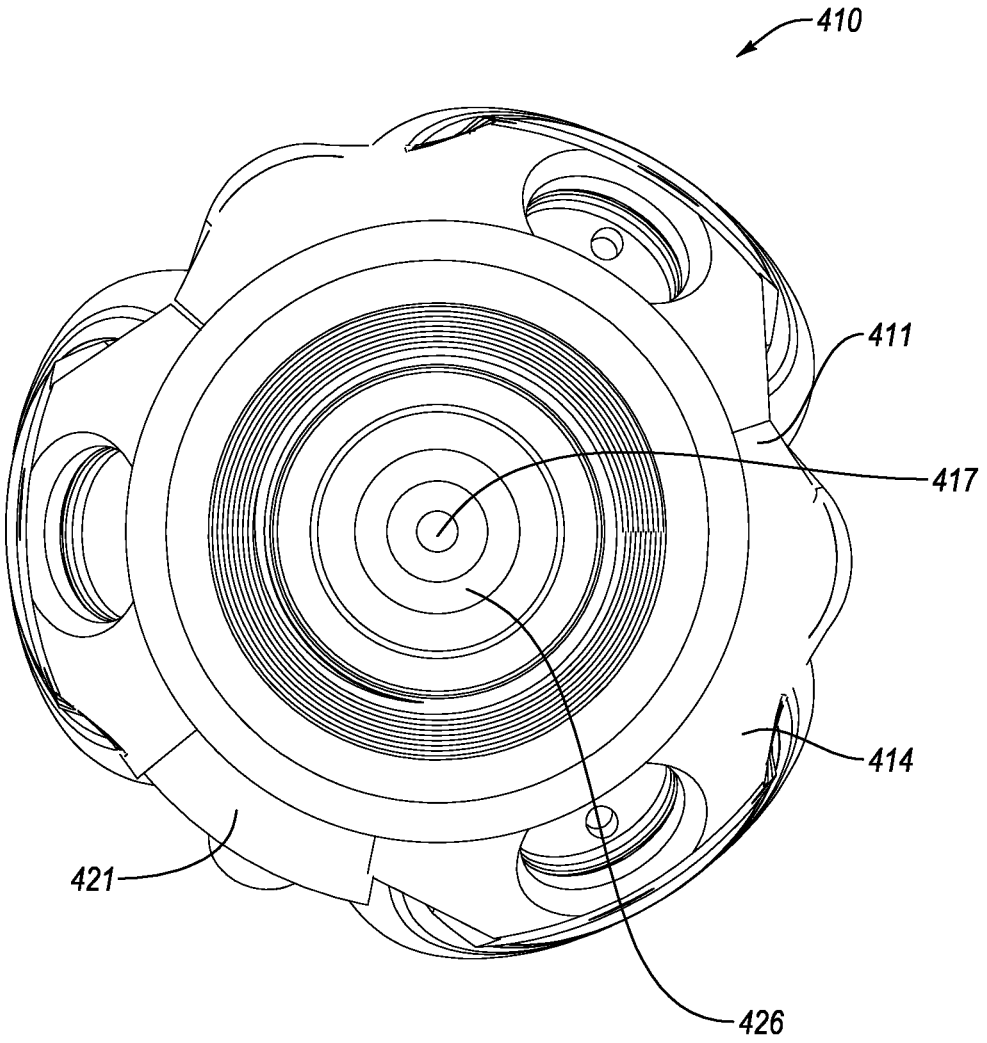
FIG. 10 is a top view of the embodiment of a roller cone bit of FIG. 6, according to the present disclosure.

FIG. 10 is a top view of the embodiment of a bit 410 in FIG. 6. The HP fluid conduit 417 provides fluid communication to a fluid pump or fluid source uphole in the drill string through the shaft 426 of the HP body 421 and to the nozzle 420.

Figure 11:
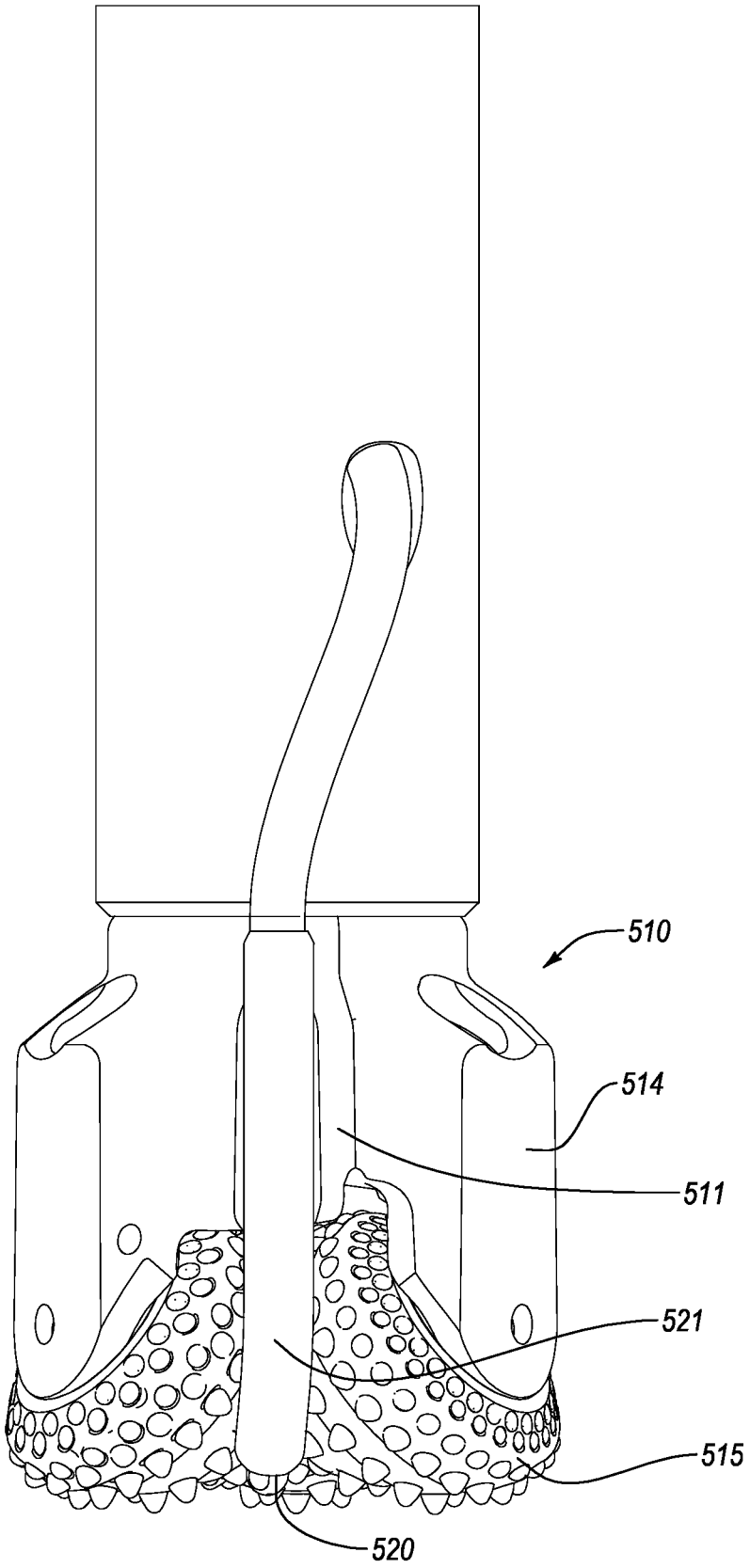
FIG. 11 is a side view of an embodiment of a roller cone bit with an external HP body joined thereto, according to the present disclosure.

FIG. 11 is an embodiment of a bit 510, according to the present disclosure, in which the nozzle 520 and HP body 521 are located externally to the bit body 511. The bit 510 has an HP body 521 that is connected to the bit body 511 externally. The HP body 521 is located angularly between the arms 514 and/or roller cones 515 of the bit 510. In some embodiments, the external HP body 521 may be bonded to the bit body 511, for example, by welding, brazing, or other bonding of the materials of the external HP body 521 and the bit body 511. In other embodiments, the external HP body 521 and the bit body 511 may be joined by one or more mechanically interlocking features, such as a tongue-and-groove connection, a dovetail connection, a friction fit, a pinned connection, or combinations thereof. In yet other embodiments, the external HP body 521 and the bit body 511 may be joined with the use of one or more adhesives. In at least one embodiment, the external HP body 521 and the bit body 511 may be joined by a combination of the foregoing, such as through welding of mechanically interlocking faces of the external HP body 521 and the bit body 511.

Figure 12:
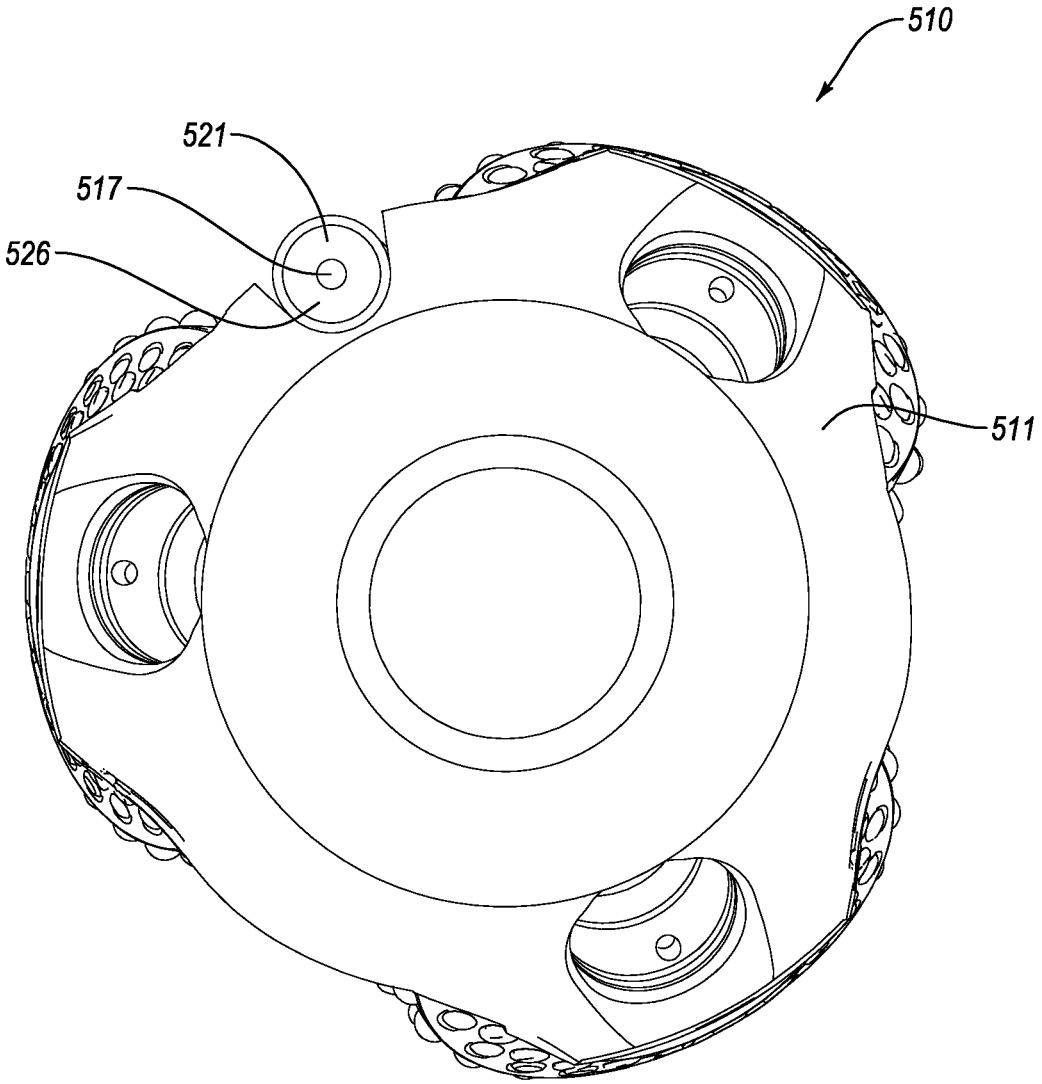
FIG. 12 is a top view of the embodiment of a roller cone bit of FIG. 11, according to the present disclosure.
Figure 13:
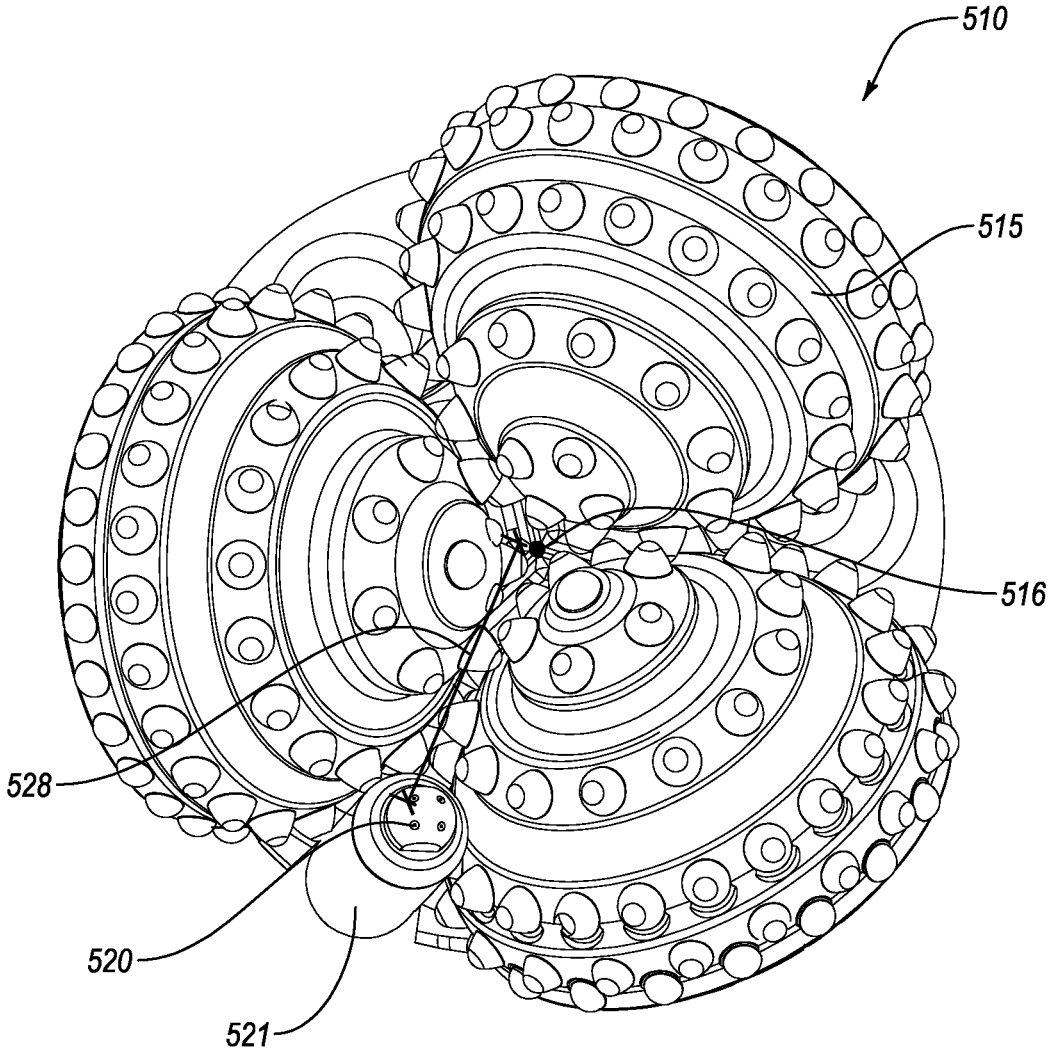
FIG. 13 is a bottom view of the embodiment of a roller cone bit of FIG. 11, according to the present disclosure.

As shown in the top view of the bit 510 in FIG. 12, the external HP body 521 may be positioned at least partially radially within the bit body 511. The shaft 526 may extend in a longitudinal direction and provide fluid communication to the nozzle 520 (shown in FIG. 13). FIG. 13 is a bottom view of the bit 510 illustrating the radial displacement of the nozzle 520 radially inward toward the center axis 516. In some embodiments, the external HP body 521 may curve or otherwise angle radially inward to support the nozzle 520 closer to the center axis 516 and/or the roller cones 515. In some embodiments, a radial position 528 of the nozzle 520 may be in a range having upper and lower values including any of 50%, 55%, 60%, 65%, 70%, 75%, 80%, 85%, 90%, 95%, 100%, or any values therebetween of the total radius of the bit 510 (i.e., the distance from the center axis 516 to a gage surface). For example, the nozzle 520 may have a radial position 528 that is in a range of 50% to 100% of the total radius of the bit 510. In another example, the nozzle 520 may have a radial position 528 that is in a range of 60% to 95% of the total radius of the bit 510. In yet another example, the nozzle 520 may have a radial position 528 that is in a range of 70% to 90% of the total radius of the bit 510.

The bit 510 is shown in FIG. 13 with a plurality of nozzles 520 at the end of the HP body 521. In some embodiments, an inner diameter ("ID") of a nozzle 520 may be in a range having upper and lower values including any of 0.010 in. (0.254 mm), 0.015 in. (0.381 mm), 0.020 in. (0.508 mm), 0.025 in. (0.635 mm), 0.030 in. (0.762 mm), 0.035 in. (0.889 mm), or any values therebetween. For example, an ID of a nozzle 520 may be between 0.010 in. (0.254 mm) and 0.035 in. (0.889 mm). In other examples, the ID of a nozzle 520 may be between 0.015 in. (0.381 mm) and 0.030 in. (0.762 mm).

In some embodiments, the plurality of nozzles 520 may be fixed relative to the HP body 521. In other embodiments, the plurality of nozzles 520 may be movable relative to the HP body 521. For example, the plurality of nozzles 520 may be rotatable relative to the HP body 521. In other words, the four nozzles 520 at the end of the HP body 521 may rotate to distribute the HP fluid jet ejected from each nozzle over a larger area during use of the bit 510. The rotation of the nozzles 520, combined with the rotation of the bit 510 during use, may create a wave form, spiral function, or other repeating path pattern of the fluid jet.

Figure 14:
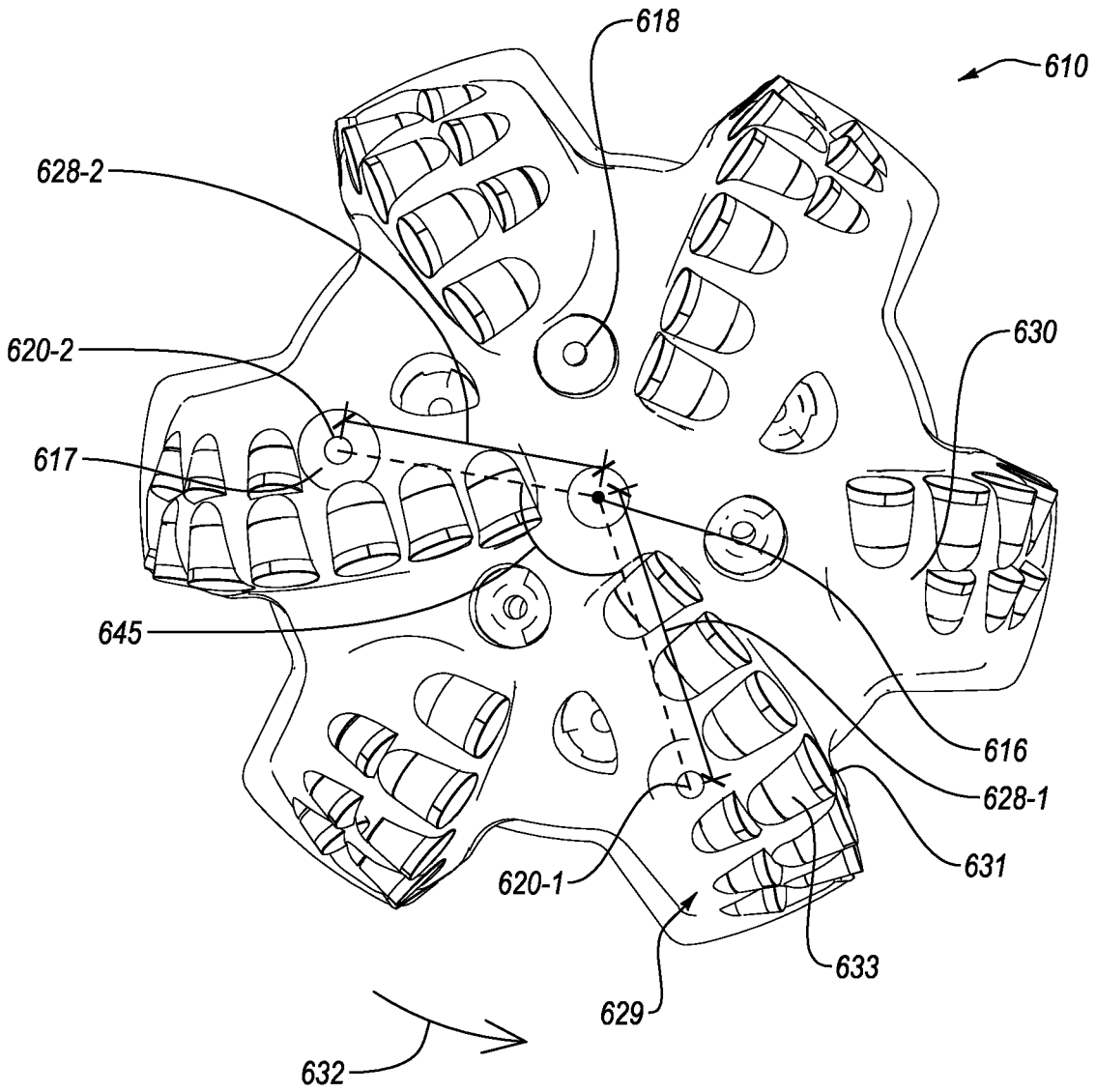
FIG. 14 is a bottom view of an embodiment of a drag bit having an HP body located therein, according to the present disclosure.

While embodiments of roller cone bits have been described so far, an HP fluid conduit, according to the present disclosure, may be applicable in other applications, such as an embodiment of a PDC bit shown in FIG. 14. The embodiment of a PDC bit 610 has a plurality of primary blades 629 and a plurality of secondary blades 630 extending radially outward from a center axis 616 of the bit 610. In other embodiments, a PDC bit may have only primary blades. Each of the blades 629, 630 has a cutting surface 631 oriented in the rotational direction of the PDC bit indicated by the arrow 632. The cutting surface 631 and/or other surfaces of the blades 629, 630 may have one or more cutting elements 633, such as PDC cutters, positioned thereon. One or more LP fluid conduits 618 may be positioned in the bit 610 to flush away debris cut by the cutting elements 633.

The PDC bit 610 may use one or more HP fluid conduits to deliver fluid to nozzles. In some embodiments, the PDC bit 610 has a first nozzle 620-1 on a primary blade and a second nozzle 620-2 on another primary blade 629. In other embodiments, a nozzle may be located on a secondary blade 630. In yet other embodiments, a nozzle may be located on the bit 610 between the primary blades 629 and secondary blades 630 in the body of the bit where the LP fluid conduits 618 are located.

The first nozzle 620-1 and second nozzle 620-2 may be located on different blades. In some embodiments, the first nozzle 620-1 and second nozzle 620-2 may be positioned on the bit 610 relative to the center axis 616 at an angular spacing 645 (similar to the angular spacing between roller cones in a roller cone bit embodiment). The angular spacing 645 may be in a range having upper and lower values including any of 0° (i.e., angularly aligned along a radial line from the center axis 616), 10°, 20°, 30°, 40°, 50°, 60°, 70°, 80°, 90°, 100°, 110°, 120°, 130°, 140°, 150°, 160°, 170°, 180° (i.e., opposing one another on opposite sides of the center axis 616), or any values therebetween. For example, the angular spacing 645 may be in a range of 0° to 180°. In another example, the angular spacing 645 may be in a range of 20° to 150°. In yet another example, the angular spacing 645 may be in a range of 40° to 120°.

The first nozzle 620-1 and second nozzle 620-2 may be located at the same radial distance or different radial distances. In some embodiments, the first nozzle 620-1 may be located at a first radial distance 628-1 and the second nozzle 620-2 may be located at a second radial distance 628-2 that is less than the first radial distance 628-1. In other embodiments, the first nozzle 620-1 may be located at a first radial distance 628-1 and the second nozzle 620-2 may be located at a second radial distance 628-2 that is greater than the first radial distance 628-1. In yet other embodiments, the first nozzle 620-1 may be located at a first radial distance 628-1 and the second nozzle 620-2 may be located at a second radial distance 628-2 that is the same as the first radial distance 628-1.

Figure 15:
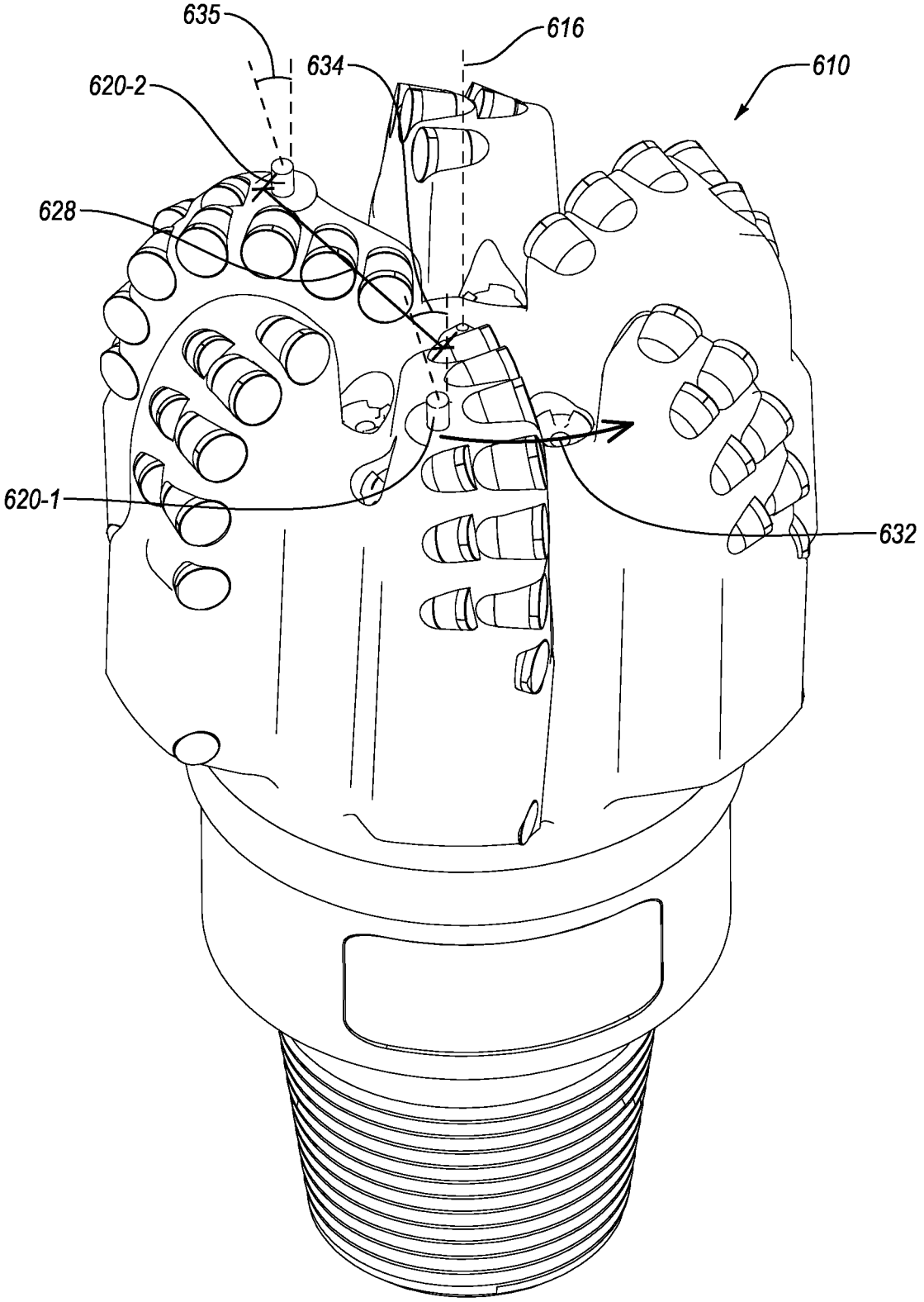
FIG. 15 is a perspective view of the embodiment of a drag bit of FIG. 14, according to the present disclosure.

FIG. 15 depicts the relative angles at which a fluid jet may be oriented relative to the bit 610. For example, the first nozzle 620-1 is shown with a rake angle 634 relative to the rotational direction of the bit 610 shown as arrow 632. The rake angle 634 may be a positive rake angle (in the direction of the rotation), a negative rake angle (against the direction of rotation), or a neutral rake angle (parallel to the center axis 616). In some embodiments, the rake angle 634 may be in a range having upper and lower values including any of −30°, −20°, −15°, −10°, −5°, 0°, 5°, 10°, 15°, 20°, 30°, or any values therebetween. For example, the rake angle 634 may be in a range of −30° to 30°. In other examples, the rake angle 634 may be in a range of −20° to 20°. In yet other examples, the rake angle 634 may be in a range of −15° to 15°.

The second nozzle 620-2 is shown with a siderake angle 635 relative to the radial distance 628. The siderake angle 635 may be a positive siderake angle (away from the center axis 616), a negative siderake angle (toward the center axis 616), or a neutral siderake angle (parallel to the center axis 616). In some embodiments, the siderake angle 635 may be in a range having upper and lower values including any of −30°, −20°, −15°, −10°, −5°, 0°, 5°, 10°, 15°, 20°, 30°, or any values therebetween. For example, the siderake angle 635 may be in a range of −30° to 30°. In other examples, the siderake angle 635 may be in a range of −20° to 20°. In yet other examples, the siderake angle 635 may be in a range of −15° to 15°.

Figure 16:
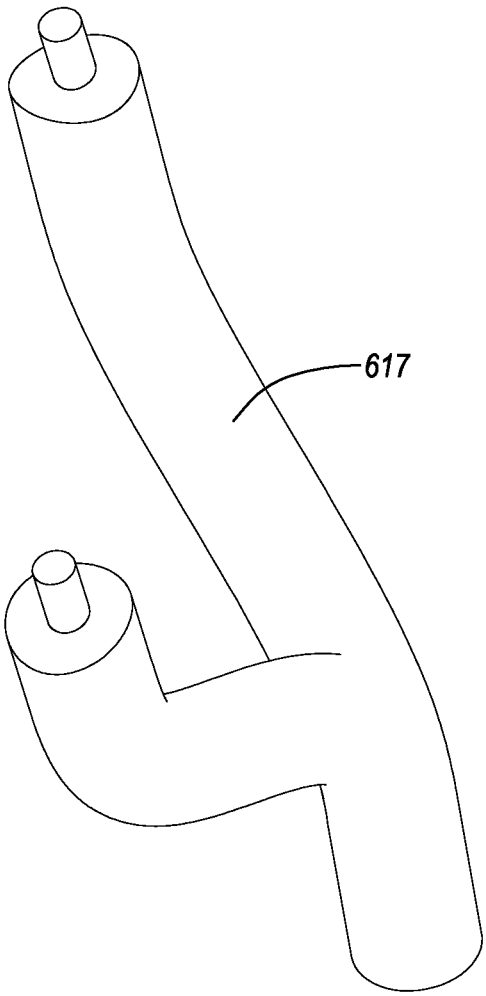
FIG. 16 is a perspective view of the embodiment of an HP body of FIG. 14, according to the present disclosure.

In some embodiments, a PDC bit may have integral HP fluid conduits that are cast into the bit body. In other embodiments such as the embodiment described in relation to FIG. 14 and FIG. 15, a PDC bit may have an HP fluid conduit 617, such as that shown in FIG. 16, around which the PDC bit may be cast or sintered. HP fluid conduit 617 is formed from a material capable of withstanding fluid pressures greater than 40 kilopounds per square inch (kpsi) (276 megapascals (MPa)).

Figure 17:
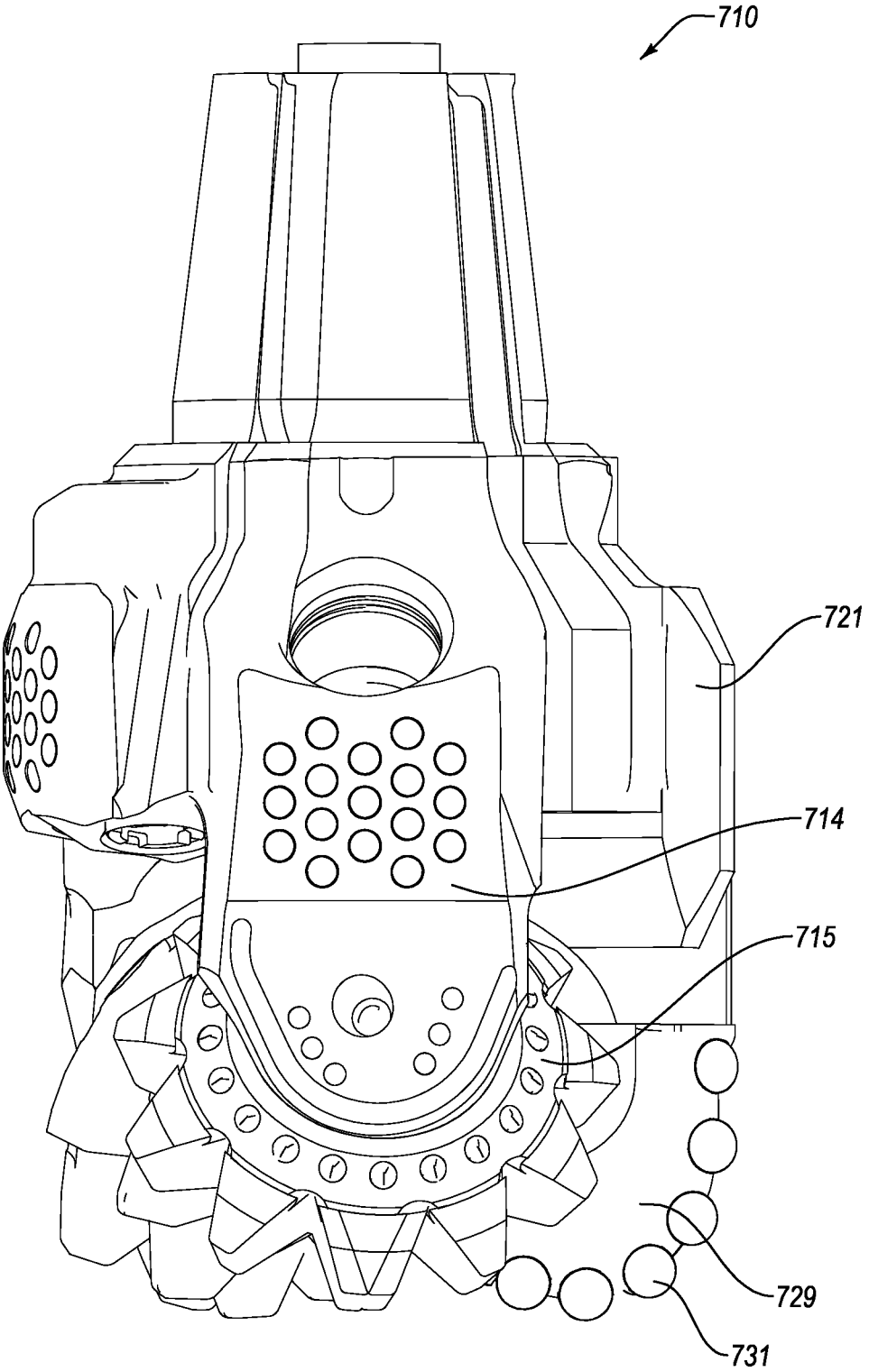
FIG. 17 is a side view of an embodiment of a hybrid bit having an HP body joined thereto, according to the present disclosure.

Some elements of a PDC bit and some elements of a roller cone bit may be combined in a hybrid bit, such as that shown in FIG. 17. A hybrid bit 710 may include at least one arm 714 and/or roller cone 715, as well as at least one primary blade 729 with a cutting surface 731. The hybrid bit 710 has one or more HP bodies 721 connected to the hybrid bit 710. For example, the hybrid bit 710 may have at least one HP body 721 positioned between a roller cone 715 and a primary blade 729, in front of the cutting surface 731. In other examples, the hybrid bit 710 may have at least one HP body 721 positioned between a roller cone 715 and a primary blade 729, behind the cutting surface 731.

Figure 18:
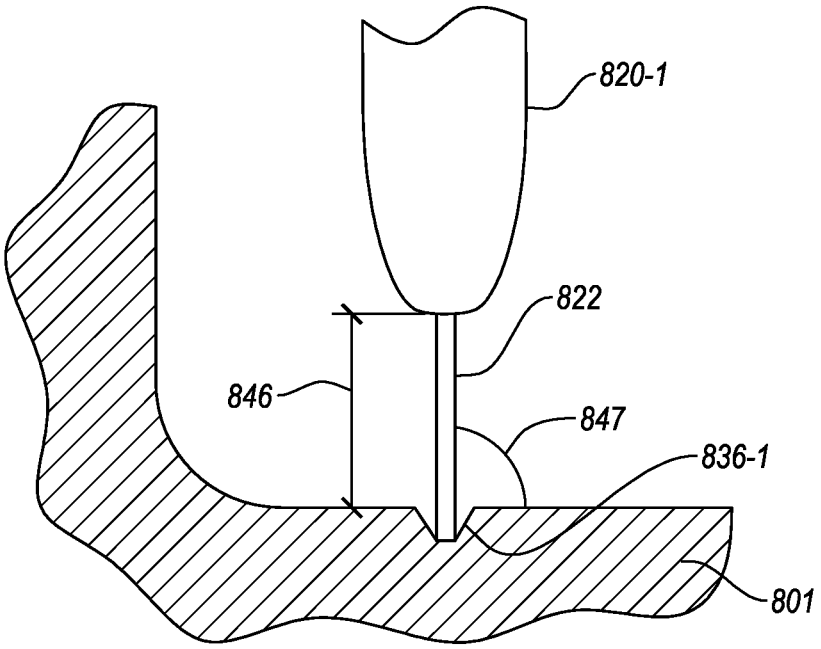
FIG. 18 is a schematic representation of the interaction of a fluid jet and a formation, according to the present disclosure.
Figure 19:
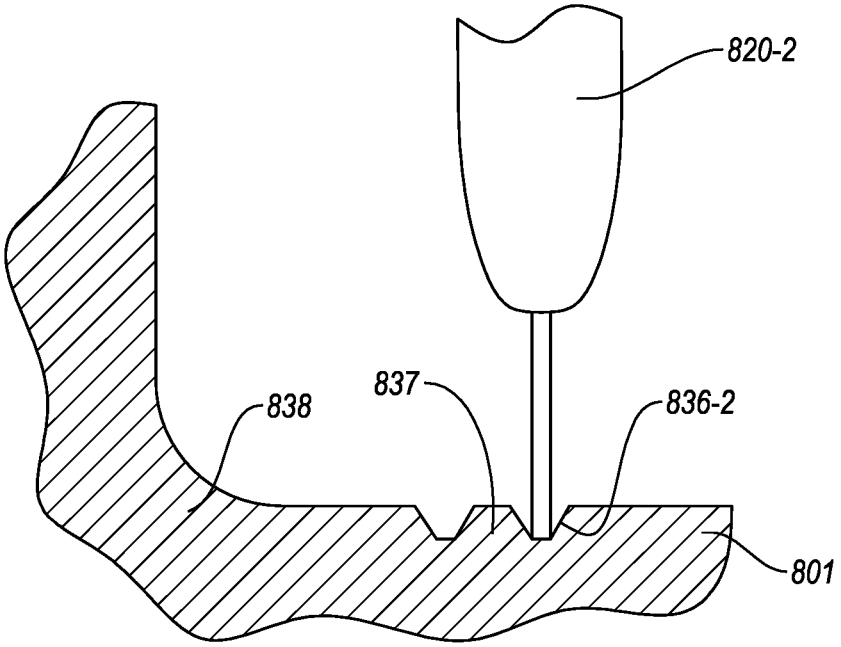
FIG. 19 is a schematic representation of an interaction of a second fluid jet and the formation of FIG. 18, according to the present disclosure.

FIG. 18 and FIG. 19 schematically illustrate a transverse cross-section of an embodiment of an interaction of a fluid jet from a nozzle with an earth formation during use of a bit according to the present disclosure. FIG. 18 shows a first nozzle 820-1 directing a fluid jet 822 toward the formation 801 to create a first cut 836-1 in the formation 801. The fluid jet 822 is shown at a neutral radial incident angle 847 (i.e., perpendicular to a surface of the formation 801 in a radial direction). In other embodiments, a radial incident angle 847 relative to the surface of the formation may be in a range having upper and lower values including any of −30°, −20°, −15°, −10°, −5°, 0°, 5°, 10°, 15°, 20°, 30°, or any values therebetween. For example, the radial incident angle 847 may be in a range of −30° to 30°. In other examples, the radial incident angle 847 may be in a range of −20° to 20°. In yet other examples, the radial incident angle 847 may be in a range of −15° to 15°. The radial incident angle 847 may affect the shape and depth of the first cut 836-1. The radial incident angle 847 may be at least partially based on the type of formation 801 being cut. The radial incident angle 847 may be at least partially dependent upon the siderake angle of a nozzle (such as siderake angle 635 described in relation to FIG. 15).

The jet length 846 is a distance from the first nozzle 820-1 to the formation 801. In some embodiments, the jet length 846 may be in a range having upper and lower values including any of 0.05 in. (1.27 mm), 0.10 in. (2.54 mm), 0.15 in. (3.81 mm), 0.20 in. (5.08 mm), 0.25 in. (6.35 mm), 0.30 in. (7.62 mm), 0.35 in. (8.89 mm), 0.40 in. (10.2 mm), 0.45 in. (11.4 mm), 0.50 in. (12.7 mm), 0.55 in. (14.0 mm), 0.60 in. (15.2 mm), 0.65 in. (16.5 mm), 0.70 in. (17.8 mm), 0.75 in. (19.1 mm), 0.80 in. (20.3 mm), 0.85 in. (21.6 mm), 0.90 in. (22.9 mm), 0.95 in. (24.1 mm), 1.0 in. (25.4 mm), and any values therebetween. For example, a jet length 846 may be between 0.05 in. (1.27 mm) and 1.0 in. (25.4 mm). In other examples, a jet length 846 may be between 0.10 in. and 0.95 in. In yet other examples, a jet length 846 may be between 0.15 in. and 0.90 in.

The jet length 846, fluid pressure, rotational speed, downhole hydrostatic pressure, rock strength, rake angle (such as rake angle 634 described in relation to FIG. 15), and radial incident angle 847 of the fluid jet 822 produced by the first nozzle 820-1 may affect the shape and depth of the first cut 836-1. The first cut 836-1 may weaken a surface of the formation 801 allowing a bit to more readily remove material from the formation 801.

FIG. 19 illustrates a second nozzle 820-2 positioned at a different radial distance from the first nozzle of FIG. 18 (similarly to the first nozzle 620-1 and second nozzle 620-2 described in relation to FIG. 14). As a bit rotates, the second nozzle 620-2 creates a second cut 836-2. An unsupported region 837 is formed between the two cuts disconnected from the formation 801 on at least two sides of the unsupported region 837. The unsupported region 837 of the formation 801 is less stable than a supported region 838 which is still disconnected to the formation 801 on only one side of the supported region. Creation of unsupported regions 837 of formation 801 during rotation of a roller cone bit, PDC bit or drag bit, hybrid bit, or other forms of cutting bits may reduce torque on the drilling system, reduce wear on the bit, increase the rate of penetration, reduce energy expenditure, reduce stick-slip behavior, provide other benefits, or combinations thereof.

Figure 20:
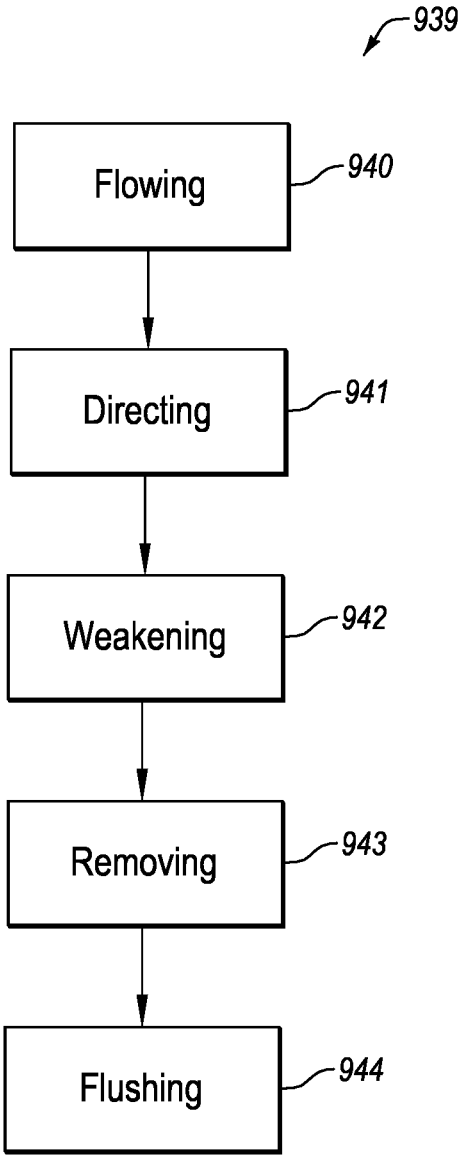
FIG. 20 is a flowchart illustrating an embodiment of a method of removing material, according to the present disclosure.

A flowchart of an embodiment of a method 939 of using a bit according to the present disclosure is shown in FIG. 20.

The method 939 includes flowing 940 a fluid through an HP fluid conduit at a fluid pressure greater than 40 kpsi (276 MPa) and directing 941 the fluid at a formation. The method 939 further includes weakening 942 the formation with the HP fluid jet and then removing 943 at least a portion of the weakened region of the formation before flushing 944 the cuttings of the weakened region away. For example, removing 943 weakened region may include using a roller cone and/or a blade having cutting elements on the blade. In some embodiments, flushing 944 material may be performed with a LP fluid delivered through a LP fluid conduit. In other embodiments, the flushing 944 may include using the fluid from the HP fluid conduit.

Figure 21:
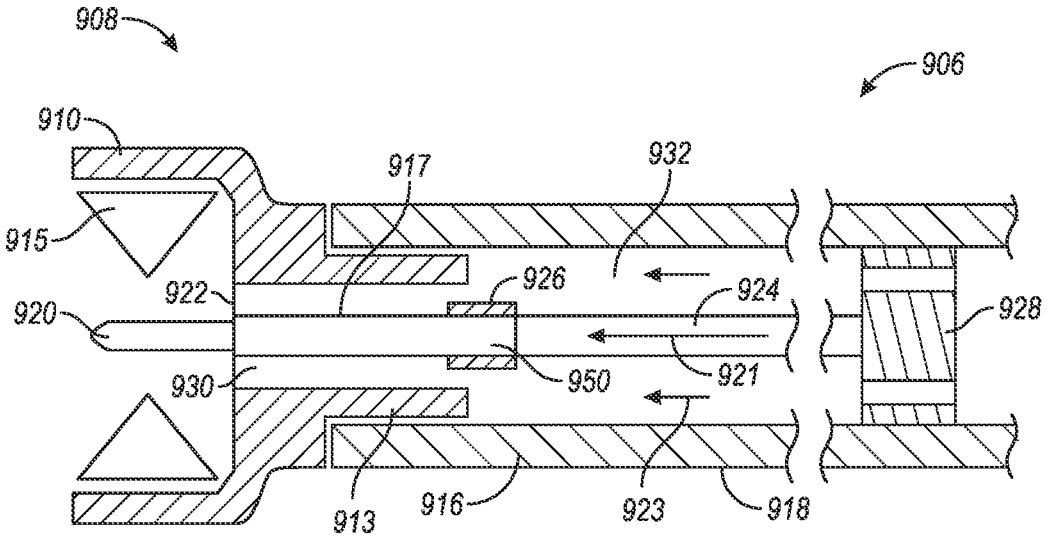
FIG. 21 is a schematic cross-sectional view of a downhole drilling system, according to the present disclosure.

Additional aspects and features of the present disclosure are contemplated, and some such aspects and features will be appreciated in view of the included documents. For instance, FIG. 21 schematically illustrates a high-pressure drill bit system 908 of a BHA 906 in accordance with some aspects of the present disclosure. The high-pressure drill bit 910 may include roller cones 915 and one or more HP nozzles 920. A bit pin 913 facilitates coupling the drill bit 910 to a connection 916 (e.g., box connection) of a component 918 of the BHA 906. The high-pressure drill bit 910 may include one or more non-HP nozzles 922 (e.g., LP nozzles or LP openings). The one or more HP nozzles 920 may be coupled to a first fluid conduit 917 (e.g., rigid connector), while the non-HP nozzles 922 are connected to a second fluid conduit 930. For instance, in FIG. 21, the HP nozzle 920 may be coupled to the rigid connector 917 and an HP pipe 924 via an HP connection interface 926. As discussed above, the one or more HP nozzles 920 may direct a HP fluid 921 toward a formation, and the one or more non-HP nozzles 922 may direct a LP fluid 923 toward the formation, the roller cones 915, or portions of the drill bit 910. The HP connection interface 926 may be at least partially within a passage 932 that conveys the LP fluid 923 to the drill bit 910.

Fluid 921 in the HP pipe 924 may flow from a downhole pressure intensifier 928 (e.g., pump, motor) that takes fluid flow in the downhole BHA 906 and increases pressure. In some embodiments, the downhole pressure intensifier 928 (DPI) is coupled directly to the drill bit 910. The DPI 928 may be indirectly coupled to the drill bit 910 via intermediate components 918, such as components 918 of the BHA 906. In some embodiments, the DPI 928 is disposed on a surface, and the DPI 928 supplies the HP fluid 921 to the HP pipe 924, which directs the HP fluid 921 to the fluid conduit 917 of the drill bit 910.

The fluid 921 having the increased pressure from the DPI 928 will flow into the HP pipe 924. A second fluid (e.g., LP fluid 923) in the downhole system 908 may flow through the DPI 928 without pressure intensification or with reduced pressure intensification. In some embodiments, the LP fluid 923 may flow around the DPI 928. As a result, there may be both high pressure fluid 921 and low-pressure fluid 923 to the drill bit 910. The high-pressure fluid 921 may go through the drill bit fluid conduit 917 and into the HP nozzles 920, while the low-pressure fluid 923 may go through the drill bit 910 and into one or more lower pressure nozzles 922 via the passage 932. In some embodiments, the low pressure fluid 923 may be directed from the passage 932 to a plenum within the drill bit 910 for distribution to the one or more low pressure nozzles 922. In at least some embodiments, the high-pressure nozzles 920, high-pressure pipe 924, and fluid conduit 917 receive flow-pressure or flow rates consistent with the high-pressure flows discussed herein, while the bit plenum and low-pressure nozzles 922 receive fluid pressure generally consistent with a standard bit. For example, the HP fluid 921 may have a pressure greater than 14.5 ksi, 20 ksi, 25 ksi, 30 ksi, 40 ksi, 50 ksi, 60 ksi, or more. The LP fluid 923 may have a pressure less than the HP fluid 921 that is suitable for removing cuttings from the wellbore, such as less than 14.5 ksi, 10 ksi, 5 ksi, 1 ksi, or less. In some embodiments, the high-pressure and low-pressure nozzles may extend from the drill bit 910 at about a same axial position; however, in other embodiments, the high-pressure nozzles 920 may extend farther downhole than the low-pressure nozzles 922, or vice versa. According to at least some embodiments, the high-pressure nozzles 920 may provide flow 921 with reduced cuttings removable capabilities as compared to the low-pressure nozzles 922.

The system 908 of FIG. 21 may be varied in any number of manners, including the configurations of the connection between the drill bit 910 and high-pressure pipe 924 configured to provide the HP fluid 921 to the HP nozzles 920. FIGS. 22-28 illustrate examples of the connections between the drill bit 910 and the DPI 928 of the DPI component 948. Although some of the examples illustrate the fluid conduit 917 of the drill bit 910 coupled directly to the high-pressure pipe 924 and the DPI 928, it is appreciated that one or more intermediate components 918 of the BHA 906 may be coupled between the fluid conduit 917 and the DPI 928. That is, the HP connection interface 926 described herein may be within the DPI 928, a steerable system component, a motor, a collar, a drill pipe, a sensor, a stabilizer, a reamer, and so forth.

Figure 22:
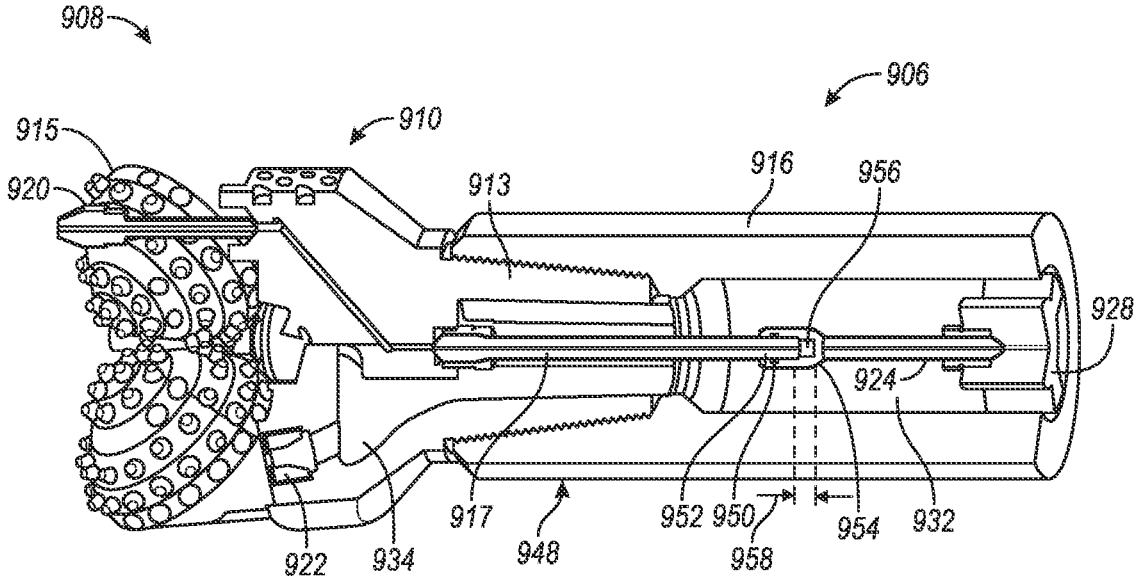
FIG. 22 is a cross-sectional view of a downhole drilling system, according to the present disclosure.

FIG. 22, for instance, illustrates an example of connecting a DPI component 948 to a drill bit 910, while using rigid connections at the HP connection interface 926, while also providing axial displacement while torqueing an API or other threaded connection at the drill bit 910 and DPI component 948. In FIG. 22, the threaded connection is between the bit pin 913 and the box connection 916 of the DPI component 948. As shown, the fluid conduit 917 or tube is coupled to the drill bit 910 and the HP pipe 924 or tube is connected within the DPI 928 of the DPI component 948. In some embodiments, both the fluid conduit 917 and the HP pipe 924 are rigid elements rather than flexible elements. A static seal 950 may then provide a connection (e.g., with tapered nose and cone configuration illustrated in FIG. 29) between the rigid connectors (e.g., fluid conduit 917 and HP pipe 924). That is, an inlet portion 952 of the fluid conduit 917 may be received by an outlet portion 954 of the HP pipe 924. In some embodiments, the inlet portion 952 of the fluid conduit 917 may receive the outlet portion 954 of the HP pipe 924. In the illustrated embodiment, the static seal 950, the fluid conduit 917, and the HP pipe 924 define a high-pressure connection interface 926 that is at least partially within, and fluidly isolated from, the low pressure fluid 923 within the passage 932. The high-pressure connection interface 926 is also fluidly isolated from a low pressure plenum 934 within the drill bit 910. In some embodiments, the HP connection interface 926 may have a volume 956 sized to allow axial movement therein of one or both of the inlet portion 952 and the outlet portion 954 while the static seal 950 maintains isolation of the HP fluid 921 from the LP fluid 923. An axial length 958 of the volume 956 may be between approximately 0.1 to 24 inches, 0.5 to 12 inches, or 1 to 3 inches.

In some embodiments, the static seal 950 may be a compression ring, such as an elastomeric compression ring or a metallic (e.g., copper) compression ring. The static seal 950 may facilitate relative axial and circumferential movement of the inlet portion 952 and the outlet portion 954 during connection of the drill bit 910 with the component 948. That is, the high-pressure connection interface 926 with the static seal illustrated in FIG. 22 may be formed simultaneously with the connection of the drill bit 910 with the DPI component 948. The static seal 950 of the high-pressure connection interface 926 can be used to create a seal whether the static seal 950 is used between two rigid tubes, two flexible tubes, or a flexible tube and a rigid tube.

Figures 1, 23:
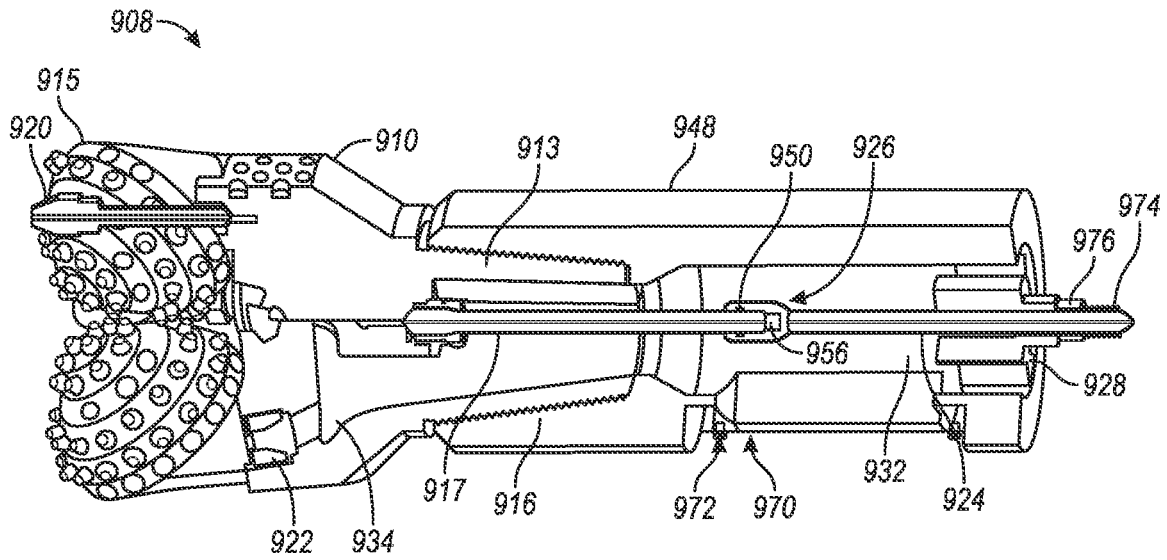
Figures 2, 23:
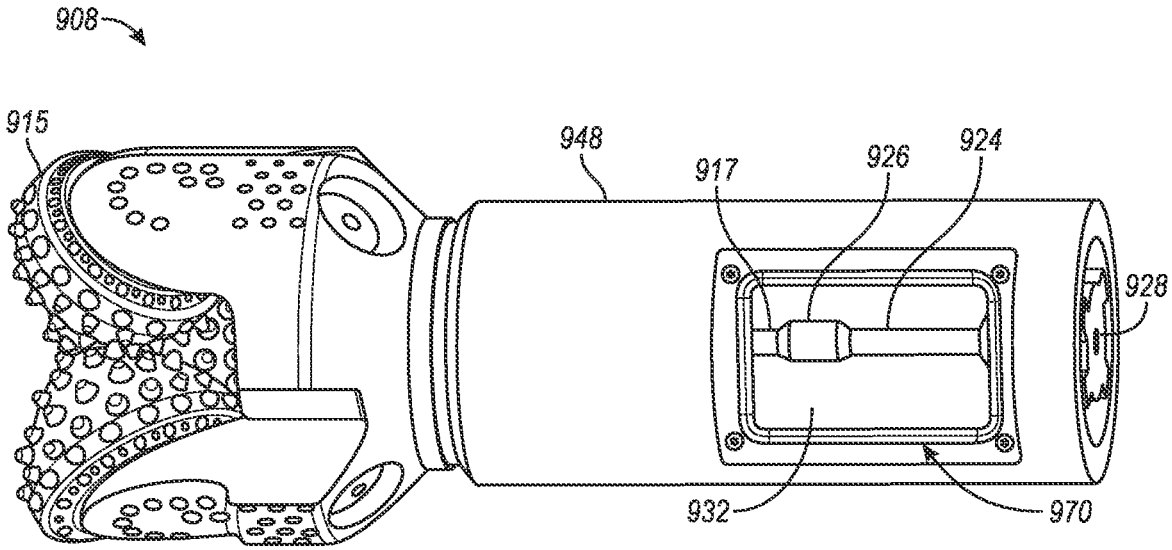

FIGS. 23-1 and 23-2 illustrate a similar design for a drill bit 910 and DPI component 948. In the illustrated embodiment, the DPI component 948 includes an access window 970 that may be selectively opened or closed. When opened at the surface, personnel may access the static seal 950 of the HP connection interface 926. In some embodiments, bolts 972, seals, or other components may be used to seal the window 970 closed and to open/close the window 970. When the window 970 is closed, the low-pressure fluid 923 may flow through the passage 932 of the DPI component 948 to the plenum 934 of the drill bit 910. The cover of the window 970 may be shaped to ensure good flow of the mud and to reduce erosion within the passage 932. The assembly of FIGS. 23-1 and 23-2 may allow axial displacement within the static seal 950 via a volume 956; however, in the same or other embodiments axial displacement may be provided in other manners. For instance, an axial tubing displacement of the fluid conduit 917 and/or the HP pipe 924 may be provided (e.g., in or near the downhole pressure intensifier) to connect and compensate for length when the bit 910 is connected to the drill collar or DPI component 948. Additionally, or in the alternative, an intermediate HP conduit may be inserted through the window 970 of the component to couple the fluid conduit 917 with the HP pipe 924 after the drill bit 910 is connected to the component. A threaded portion 974 of the HP pipe 924 may extend through an upstream end of the component 948 to facilitate a seal via a fastener 976 with a conical shape, as discussed below with FIG. 29.

Figures 1, 24:
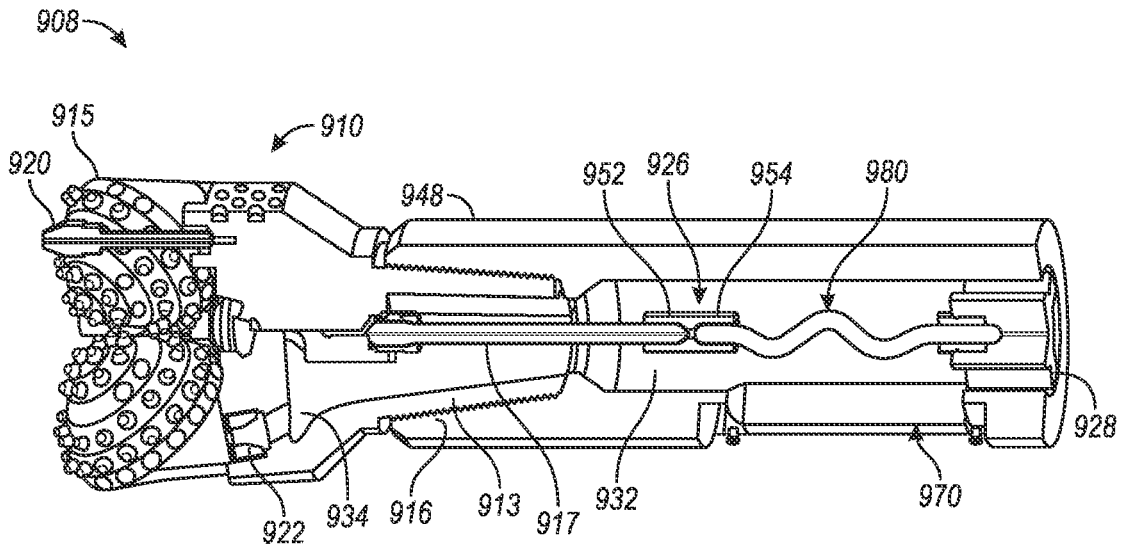
Figures 2, 24:
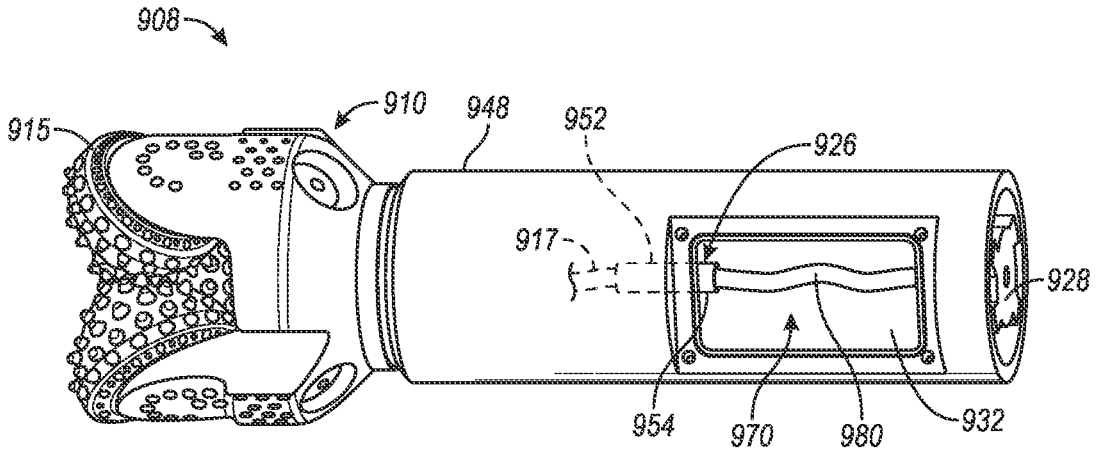

FIGS. 24-1 and 24-2 illustrate another example connection for the high-pressure flow between a drill bit 910 and a DPI component 948. In FIGS. 24-1 and 24-2, the bit 910 may include a static tube (e.g., fluid conduit 917), and a flexible tube 980 or hose may be coupled to the inlet portion 952 of the fluid conduit 917 to fluidly couple the HP nozzle 920 with the DPI 928. Optionally, an access window 970 may also be included in the outer wall of the DPI component 948, or in a drill collar component between the bit 910 and the DPI 928. The flexible tube 980 may facilitate axial and/or radial movement along the high-pressure fluid flow elements between the drill bit 910 and the DPI 928. The access window 970 may facilitate the connection of the fluid conduit 917 with the flexible tube 980 after the connection (e.g., API connection) between the drill bit 910 and the DPI component 948. In some embodiments, the flexible tube 980 may be directly coupled to the drill bit 910, and the HP pipe 924 may be the rigid component of the HP connection interface 926.

Figure 25:
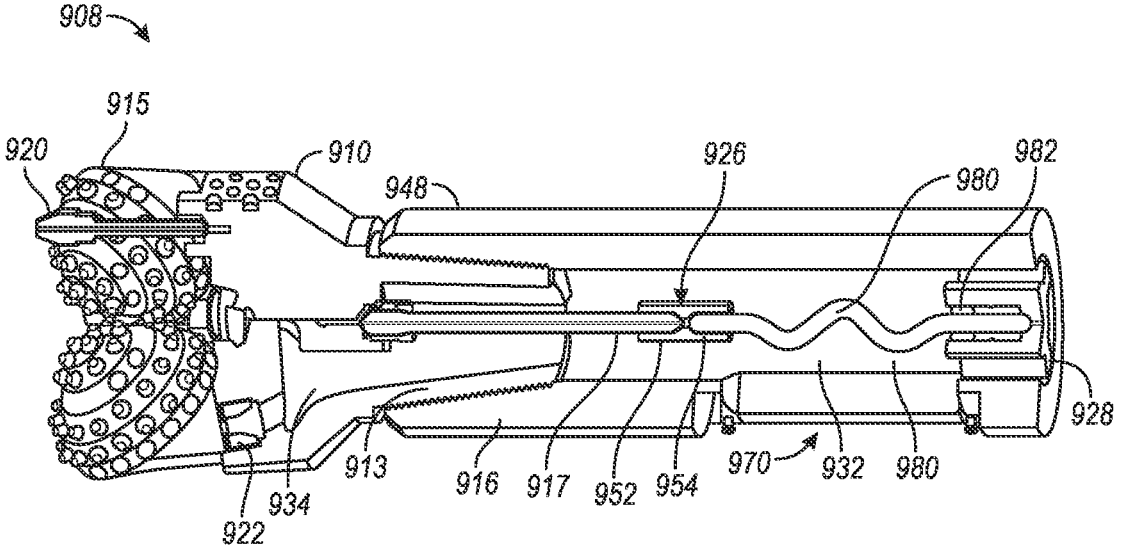
FIG. 25 is a cross-sectional view of a downhole drilling system, according to the present disclosure.

FIG. 25 shows another example connection for the high-pressure flow between a drill bit 910 and a DPI component 948. Similar to the embodiment in FIGS. 24-1 and 24-2, an optional access window 970 may be included, as is a flexible tube 980, hose or other flow component coupled to the DPI 928. In this embodiment, the DPI component 948 may also include a swivel connection 982 to the flexible tube 980 that allows rotation of the flexible tube 980 when the drill bit 910 and DPI component 948 are made up. In some embodiments, the access window 970 allows assembly of the connection 926 after make-up of the drill bit 910 and DPI component 948. The swivel connection 982 may be disposed on either end of the flexible tube 980 or the fluid conduit 917. In some embodiments, the HP connection interface 926 includes a swivel connection 982

Figures 2, 26:
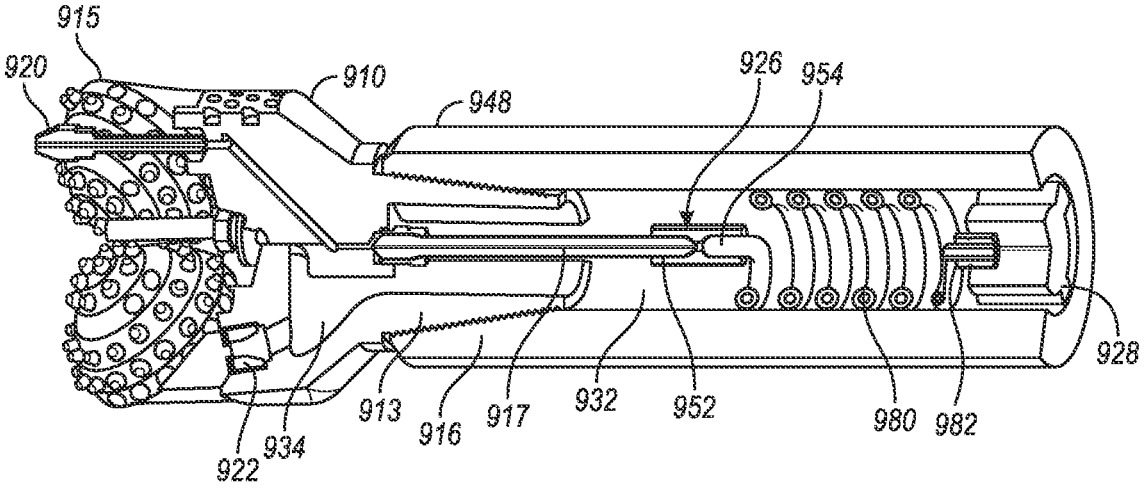
Figures 1, 26:
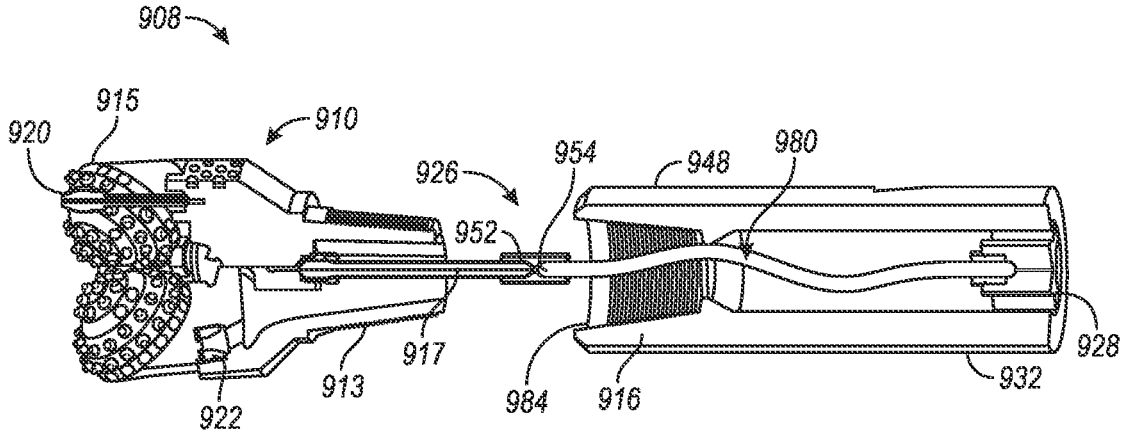

FIGS. 26-1 and 26-2 illustrate another example connection for a high-pressure flow between a drill bit 910 and a DPI component 948. In this embodiment, the flexible tube 980 of the DPI component 948 may be coupled to the fluid conduit 917 (e.g., rigid conduit) of the drill bit 910 before make-up with the DPI component 948. The flexible tube 980 may have enough length to compensate for make-up, as the flexible tube 980 or hose may coil within the passage 932 during torqueing, as illustrated in FIG. 26-2. The flexible tube 980 may be initially coupled to the fluid conduit 917 of the drill bit 910 outside of the passage 932 of the DPI component 948, as illustrated in FIG. 26-1. That is, the extended length of the flexible tube 980 may extend beyond a downhole end 984 of the DPI component 948. Whereas the window 970 discussed with FIG. 23 may facilitate forming the HP connection interface 926 after connecting the drill bit 910 to the DPI component 948, the flexible tube 980 and the length thereof described with FIG. 26 may facilitate forming the HP connection interface 926 prior to connecting the drill bit 910 to the DPI component 948.

Figure 27:
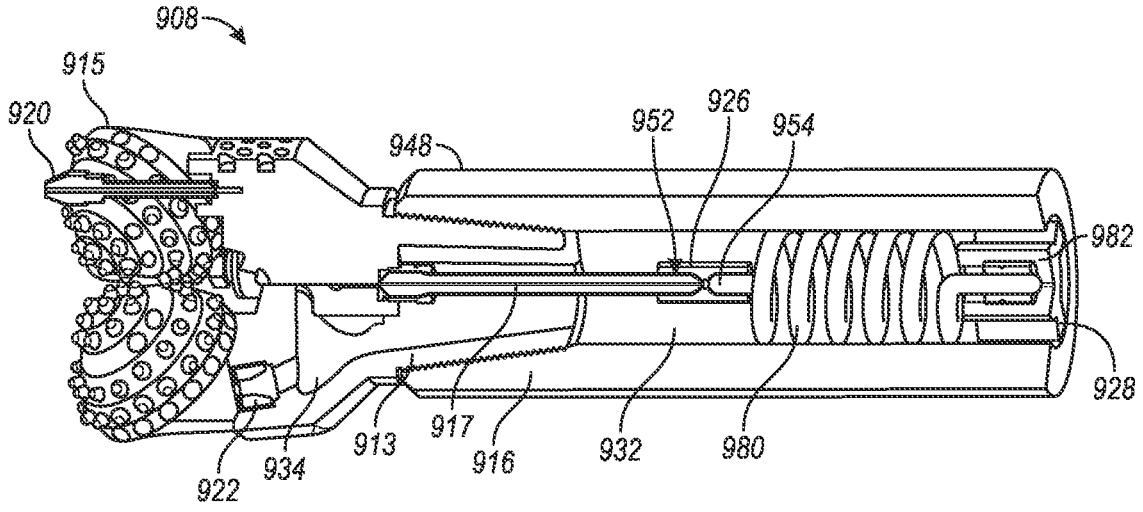
FIG. 27 is a side cross-sectional view of a downhole drilling system, according to the present disclosure.

The embodiment of FIGS. 26-1 and 26-2 may also be modified to include the swivel connection 982 or other rotatable connection between the flexible tube 980 and the DPI 928, as shown in the embodiment of FIG. 27. In some embodiments, the swivel connection 982 or other rotatable connector is also or instead used between the fluid conduit 917 (e.g., rigid connector) and the drill bit 910. In the same or other embodiments, the fluid conduit 917 of the drill bit 910 is flexible. Thus, both the fluid conduit 917 of the drill bit 910 and the HP pipe 924 of the DPI component 948 may be rigid, both may be flexible, or either one may be flexible while the other is rigid.

Figure 28:
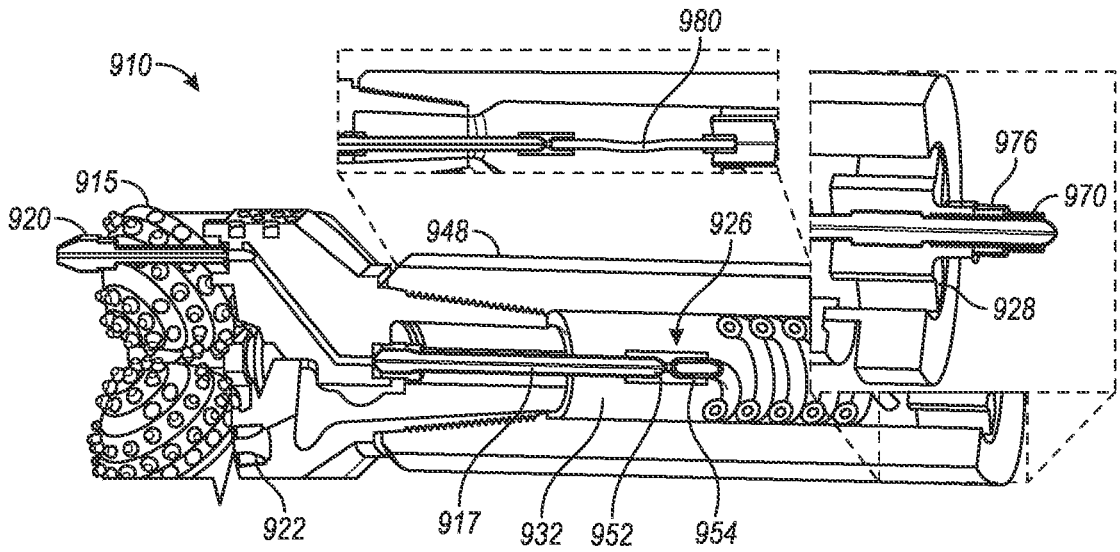
FIG. 28 is a side cross-sectional view of a downhole drilling system, according to the present disclosure.

FIG. 28 illustrates another embodiment of the high pressure drill bit system 908 combining other features described in more detail herein. For instance, in this embodiment, the swivel connection 982 is included between the flexible tube 980 and the DPI 928, as shown with enlarged view "a" of FIG. 28. As discussed with FIG. 26, the flexible tube 980 (as shown with enlarged view "b" of FIG. 28) may have sufficient length to facilitate coupling with the fluid conduit 917 outside of the passage 932 and to be coiled within the passage 932 upon connection of the drill bit 910 with the DPI component 948 (as shown with view "c" of FIG. 28). As discussed with FIG. 23, the threaded portion 974 of the HP pipe 924 may be connected to the DPI 928 with the fastener 976. Additionally, axial regulation is included in the DPI 928 and/or in the high-pressure connection interface 926 to allow the flexible tube 980 to be moved axially relative to the connection to the DPI 928.

Embodiments of the present disclosure have shown preliminary results that are promising for the field. For instance, an example embodiment of a drill bit with one high-pressure nozzle was shown to have a 70% rate of penetration increase relative to a comparable standard roller cone bit when drilling in granite. An example embodiment with two high-pressure nozzles was shown to have a 42% rate of penetration increase over the baseline bit.

Figure 29:
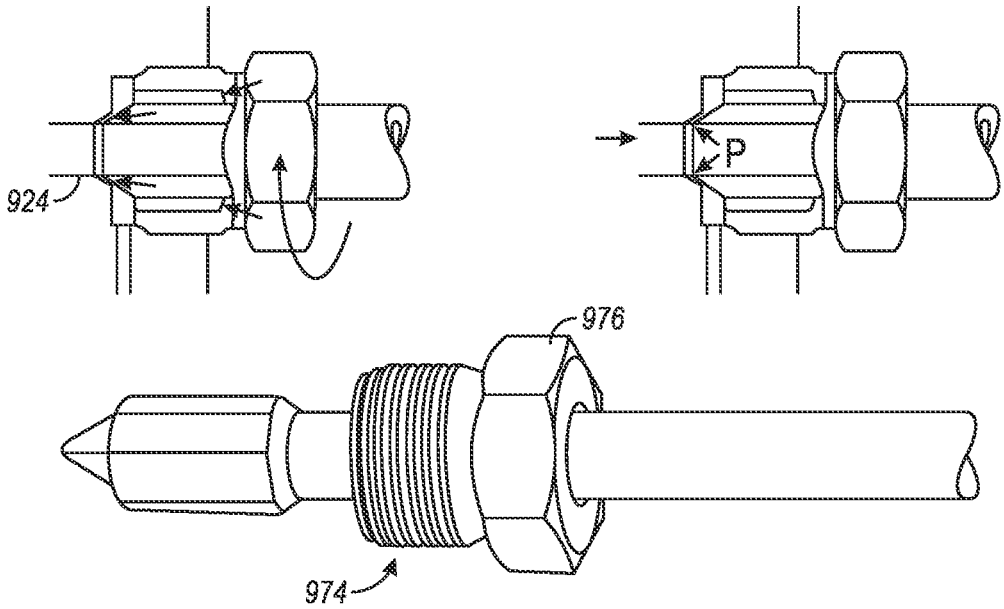
FIG. 29 includes side and partial side, cross-sectional views of high-pressure connections, according to the present disclosure.

FIG. 29 illustrates some examples of HP connections that may be used in accordance with embodiments of the present disclosure. The illustrated connections may be similar to those used in other high-pressure applications (e.g., water jetting), and may be rated for pressures of 1,000 to 10,000 bar or 14,500 to 145,000 psi.

In operation, embodiments may include connecting an HP connector/pipe to a rigid bit connection and sliding a flexible connector through the box connection of the downhole pressure intensifier. The box connection may be coupled to the bit pin. Optionally, swivels, axial compensation, access windows, or other techniques may be used to facilitate high-pressure connections.

While embodiments of bits and fluid conduits have been primarily described with reference to wellbore drilling operations, the bits and fluid conduits described herein may be used in applications other than the drilling of a wellbore. In other embodiments, bits and fluid conduits according to the present disclosure may be used outside a wellbore or other downhole environment used for the exploration or production of natural resources. For instance, bits and fluid conduits of the present disclosure may be used in a borehole used for placement of utility lines. In other examples, bits and fluid conduits of the present disclosure may be used in wireline applications and/or maintenance applications. Accordingly, the terms "wellbore," "borehole," and the like should not be interpreted to limit tools, systems, assemblies, or methods of the present disclosure to any particular industry, field, or environment.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. It should be understood that any directions or reference frames in the preceding description are merely relative directions or movements. For example, any references to "up" and "down" or "above" and "below" are merely descriptive of the relative position or movement of the related elements. Any element described in relation to an embodiment or a figure herein may be combinable with any element of any other embodiment or figure described herein.

Any element described in relation to an embodiment or a figure herein may be combinable with any element of any other embodiment or figure described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

SPONSORED RESEARCH AND DEVELOPMENT

The project leading to this application has received funding from the European Union's Horizon 2020 research and innovation program under Grant Agreement No. 641202.

What is claimed is:

1. A system for removing material, comprising:
- a first conduit; and
- a bit, including:
  - a bit body;
  - a bit plenum disposed in the bit body;
  - a second conduit disposed in the bit body and in communication with the bit plenum;
  - a third conduit at least partially disposed in the second conduit disposed in the bit body and in fluid communication with the first conduit, wherein the first conduit and third conduit are fluidly isolated from the second conduit;
  - a first nozzle in fluid communication with the third conduit; and
  - a second nozzle coupled to the bit body and in fluid communication with the bit plenum and the second conduit.

2. The system of claim 1, wherein the first conduit is coupled to the third conduit via a connection interface, and the connection interface is at least partially within and fluidly isolated from the second conduit.

3. The system of claim 1, the bit further comprising a first roller cone and a second roller cone extending farther from a face of the bit body than the first nozzle, wherein the first nozzle is positioned rotationally between the first roller cone and the second roller cone, and the first nozzle is configured to direct a fluid jet toward a location in a rotational path of the first roller cone and the second roller cone.

4. The system of claim 1, wherein the first conduit extends through the bit body, wherein the first nozzle is coupled to the first conduit externally from the bit body, and the first conduit is coupled to the bit body by mechanically interlocking features, bonding, or any combination thereof.

5. The system of claim 1, the bit comprising a third nozzle in fluid communication with the third conduit.

6. The system of claim 1, wherein a radial position of the first nozzle is between 70% to 90% of a total radius of the bit.

7. The system of claim 1, the second nozzle providing increased cuttings removal as compared to the first nozzle.

8. The system of claim 1, the bit further comprising a first roller cone and a second roller cone, the first nozzle extending from a face of the bit body between the first roller cone and the second roller cone, wherein the second nozzle is positioned above the first roller cone and the second roller cone.

9. The system of claim 1, wherein the first conduit is a flexible conduit.

10. The system of claim 9, wherein the first conduit is coiled.

11. The system of claim 1, further comprising:

a tubular housing coupled a first end of the bit body;

a passage defined by an inner surface of the tubular housing and in fluid communication with the second conduit and the bit plenum, and wherein the first conduit is disposed in the passage.

12. The system of claim 1, further comprising a plurality of arms extending from the bit body, each arm supporting a roller cone configured to rotate relative to the respective arm.

13. The system of claim 1, wherein the first nozzle extends farther in a longitudinal direction from the bit body than the second nozzle.

14. The system of claim 1, further comprising a downhole pressure intensifier coupled to the third conduit, wherein the downhole pressure intensifier is configured to pressurize a fluid through the first nozzle to greater than 40 ksi, wherein fluid through the second nozzle is at a pressure less than 14.5 ksi.

15. The system of claim 14, wherein the downhole pressure intensifier is coupled directly to the bit.

16. The system of claim 15, wherein the downhole pressure intensifier comprises:

a passage in fluid communication with the second conduit;

the first conduit; and an access window through a body of the downhole pressure intensifier to the passage, wherein a connection interface between the first conduit and the third conduit is accessible via the access window when the downhole pressure intensifier is coupled to the bit.

17. The system of claim 16, wherein the connection interface comprises an axial displacement chamber.

18. The system of claim 16, wherein the connection interface comprises a swivel connection.

19. The system of claim 1, further comprising:

an inlet portion of the third conduit is disposed in an outlet portion of the first conduit, wherein the inlet portion is axially moveable relative to the outlet portion, and wherein a seal is disposed between the inlet portion and the outlet portion.

* * * * *